US007758320B2

(12) United States Patent
Pham et al.

(10) Patent No.: US 7,758,320 B2
(45) Date of Patent: Jul. 20, 2010

(54) TWO-STAGE HYDRODYNAMIC PUMP AND METHOD

(75) Inventors: Hoa Dao Pham, Xenia, OH (US); Joseph Howard McCarthy, Bellbrook, OH (US); Jay Timothy Clementz, Xenia, OH (US); Philip Stahl, El Cajon, CA (US)

(73) Assignee: Tank, Inc., Dayton, OH (US)

( * ) Notice: Subject to any disclaimer, the term of this patent is extended or adjusted under 35 U.S.C. 154(b) by 265 days.

(21) Appl. No.: 11/743,794

(22) Filed: May 3, 2007

(65) Prior Publication Data

US 2008/0273990 A1 Nov. 6, 2008

(51) Int. Cl.
*F04B 39/02* (2006.01)
*F16C 31/06* (2006.01)

(52) U.S. Cl. ..... 417/366; 417/423.5; 417/423.12; 417/350; 384/107

(58) Field of Classification Search ..... 417/366, 417/423.12, 423.13; 384/107, 111, 112, 384/113, 322
See application file for complete search history.

(56) References Cited

U.S. PATENT DOCUMENTS 1,476,776 A * 12/1923 Stamm et al. ..... 417/350
2,814,254 A * 11/1957 Litzenberg ..... 417/350
2,830,541 A * 4/1958 Higgins et al. ..... 417/357
2,937,908 A * 5/1960 Golten ..... 384/288
3,399,000 A * 8/1968 Remmers ..... 384/99
3,420,184 A * 1/1969 Englesberg et al. ..... 417/420
3,439,961 A 4/1969 Stiles
3,502,920 A * 3/1970 Chaboseau ..... 310/90
3,891,282 A 6/1975 Tuffias
3,941,437 A * 3/1976 MacInnes et al. ..... 384/287
3,951,573 A * 4/1976 Dunning et al. ..... 417/423.13
3,955,860 A * 5/1976 Menke et al. ..... 384/415
4,013,384 A * 3/1977 Oikawa ..... 417/368
4,047,847 A * 9/1977 Oikawa ..... 417/370
4,054,293 A 10/1977 Hoeg et al.
4,082,380 A * 4/1978 Klaus et al. ..... 384/425
4,105,372 A 8/1978 Mishina et al.
4,123,675 A 10/1978 Moskowitz et al.
4,171,818 A 10/1979 Moskowitz et al.
4,200,296 A 4/1980 Stahl et al.
4,229,142 A * 10/1980 Le Dall et al. ..... 417/38
4,254,961 A 3/1981 Fersht et al.
4,407,508 A 10/1983 Raj et al.
4,444,398 A 4/1984 Black, Jr. et al.
4,493,610 A * 1/1985 Iino et al. ..... 415/104
4,526,484 A 7/1985 Stahl et al.
4,630,943 A 12/1986 Stahl et al.
4,694,213 A 9/1987 Gowda et al.
4,717,266 A 1/1988 Hart, Jr. et al.
4,764,085 A * 8/1988 Jesinger ..... 415/112
4,795,275 A 1/1989 Titcomb et al.

(Continued)

*Primary Examiner*—Devon C Kramer
*Assistant Examiner*—Nathan Zollinger
(74) *Attorney, Agent, or Firm*—Jacox, Meckstroth & Jenkins

(57) ABSTRACT

A two-stage pump having an internal fluid pathway or cycle for providing cooling to various parts in the pump, such as, an electric motor in the pump, and also for lubricating at least one or a plurality of bearings in the pump. The pump utilized hydrodynamic bearings that are adapted or configured to provide various passageways, channels and the like for using the fluid that is being pumped by the pump as lubrication for at least one or a plurality of bearings in the pump.

58 Claims, 13 Drawing Sheets

U.S. PATENT DOCUMENTS 4,797,013 A 1/1989 Raj et al.
4,808,070 A * 2/1989 Fonda-Bonardi ..... 415/110
4,809,354 A 2/1989 Kawashima
4,830,384 A 5/1989 Raj et al.
4,890,850 A 1/1990 Raj et al.
4,898,480 A 2/1990 Raj et al.
4,938,611 A 7/1990 Nii et al.
4,967,831 A 11/1990 Leland
4,969,803 A 11/1990 Turanskyj
5,005,639 A 4/1991 Leland
5,007,513 A 4/1991 Carlson
5,108,198 A 4/1992 Nii et al.
5,110,141 A 5/1992 Dayan
5,112,142 A 5/1992 Titcomb et al.
5,161,900 A 11/1992 Bougathou et al.
5,215,448 A 6/1993 Cooper
5,238,254 A 8/1993 Takii et al.
5,261,796 A * 11/1993 Niemiec et al. ..... 417/371
5,378,121 A * 1/1995 Hackett ..... 417/363
5,433,529 A * 7/1995 Hensel ..... 384/112
5,463,511 A 10/1995 Nakano et al.
5,524,985 A 6/1996 Dunfield
5,555,956 A * 9/1996 Voss et al. ..... 184/6.16
5,598,908 A 2/1997 York et al.
5,616,973 A * 4/1997 Khazanov et al. ..... 310/54
5,641,275 A * 6/1997 Klein et al. ..... 417/420
5,660,397 A 8/1997 Holtkamp
5,675,199 A 10/1997 Miyakoshi et al.
RE35,718 E 1/1998 Nii et al.
5,704,613 A 1/1998 Holtkamp
5,757,097 A 5/1998 Sato
5,888,053 A 3/1999 Kobayashi et al.
5,954,342 A 9/1999 Mikhalev et al.
5,956,204 A 9/1999 Dunfield et al.
5,969,903 A 10/1999 Parsoneault et al.
6,036,435 A * 3/2000 Oklejas ..... 415/111
6,055,126 A 4/2000 Kennedy et al.
6,062,028 A * 5/2000 Arnold et al. ..... 60/612
6,074,092 A 6/2000 Andrews
6,155,802 A 12/2000 Choi et al.
6,285,527 B1 9/2001 Kennedy et al.
6,305,694 B1 10/2001 Yamazumi et al.
6,375,438 B1 * 4/2002 Seo ..... 417/366
6,422,838 B1 * 7/2002 Sloteman ..... 417/423.5
6,547,438 B2 * 4/2003 Shima ..... 384/100
6,626,649 B2 * 9/2003 Cowans ..... 417/366
6,717,308 B2 4/2004 Chen et al.
6,899,338 B2 5/2005 Li et al.
7,048,520 B1 5/2006 McCarthy
7,129,609 B1 10/2006 Mikhalev et al.

* cited by examiner

TWO-STAGE HYDRODYNAMIC PUMP AND METHOD

BACKGROUND OF THE INVENTION

1. Field of the Invention

This invention relates to a two-stage hydrodynamic pump and, more particularly, to a pump that uses hydrodynamic bearings that are lubricated by fluid that is pumped by the pump and that cools.

2. Description of the Related Art

Two-stage pumps have been utilized in the past. One such pump is shown and described in U.S. Pat. No. 7,048,520. Typically, such pumps utilize bearings for any rotating parts in the pump. Typically, the bearings were metal-to-metal bearings that required lubrication.

One downside of the two-stage pumps of the past is that the bearings and the metal-to-metal contact of any rotating bearing members reduced the useful life of the bearings and/or the pump.

What is needed, therefore, is a system and method for improving the pump and extending the useful life of the pump.

SUMMARY OF THE INVENTION

One object of the invention is to overcome the problems of prior art pumps and to provide a two-stage pump that has a longer life than a typical two-stage pump of the past.

Another object of the invention is to provide a pump that utilizes hydrodynamic bearings.

Still another object of the invention is to provide a two-stage pump that utilizes hydrodynamic bearings that are lubricated by the fluid being pumped by the pump.

Still another object is to provide a system and method for cooling an electric motor in the pump, while substantially simultaneously lubricating at least one or the plurality of bearings in the pump.

Still another object is to provide a two-stage pump that includes an internal cycle for lubricating at least one or a plurality of the bearings in the pump and further provides an external pumping cycle for performing work.

In one aspect, one embodiment provides a multistage sealed direct drive pump for pumping a fluid, the pump comprising an electrical motor having a motor shaft, a plurality of impellers mounted on the motor shaft, a housing enclosing the electric motor and the plurality of impellers, a fluid path providing fluid communication between a first area association with a first of the plurality of impellers and a second area association with a first of the plurality of impellers; and at least one hydrodynamic bearing for supporting the motor shaft, wherein the hydrodynamic bearing comprises at least one fluid conduit for permitting the fluid to flow between the first and second areas, thereby removing heat generated by the motor and lubricating the hydrodynamic bearing.

In another aspect, one embodiment provides a multistage pump for pumping a fluid, the pump comprising a housing, an electric motor mounted in the housing, the electric motor comprising a stator and a rotor mounted on a motor shaft and situated in operative relationship to the stator, a first impeller associated with a first stage area for pressurizing the fluid to a first predetermined level, a second impeller associated with a second stage area that is in fluid communication with the first stage area, the second impeller pressurizing fluid received from the first stage area to a second predetermined level and a first hydrodynamic bearing assembly associated with the first impeller and a second hydrodynamic bearing assembly associated with the second impeller, the first and second hydrodynamic bearing assemblies being adapted to permit the fluid to flow between the first and second stage areas in order to cool the electric motor and to lubricate each of the first and second hydrodynamic bearing assemblies.

In still another aspect, another embodiment provides a hermetic pump for pumping a fluid, a housing, an electric motor situated in the housing, the electric motor comprising a motor shaft, at least one impeller mounted on the motor shaft, at least one hydrodynamic bearing assembly for rotatably supporting the motor shaft, the at least one hydrodynamic bearing assembly being adapted to permit the fluid being pumped to cool the electric motor and substantially simultaneously to lubricate the at least one hydrodynamic bearing assembly.

In yet another aspect, another embodiment provides a multistage pump for pumping a fluid comprising a housing, an electric motor hermetically sealed within the housing, the electric motor comprising a motor shaft, a first impeller mounted on the motor shaft and associated with a first area in the housing, a second impeller mounted on the motor shaft and associated with a second area in the housing, at least one passageway for permitting fluid communication between the first area and the second area, at least one bearing having at least one lubricating passageway adapted to permit fluid to flow between the first and second areas such that the fluid that is being pumped by the pump lubricates the at least one bearing.

In still another aspect, another embodiment provides a multistage pump comprising a housing comprising an electric motor having a motor shaft, a first impeller associated with a first area inside the housing, a second impeller associated with a second area inside the housing, a first bearing member mounted in the housing, and a first rotating member situated between the first impeller and the first bearing member, the first bearing member and the first rotating member being adapted to define a first hydrodynamic bearing that permits fluid to flow between the first area and the second area, thereby lubricating the first hydrodynamic bearing.

In yet another aspect, another embodiment provides a method for removing heat in a pump having a first stage area and a second stage area that is downstream of the first stage area, creating a pressure differential between the first stage area and the second stage area, providing an internal flow path from the second stage area to the first stage area such that at least a portion of the fluid being pumped by the pump is used to lubricate at least one bearing in the pump and to also cool the pump.

In still another aspect, another embodiment provides a fluid pump having an inlet an outlet comprising a housing having an electric motor having a shaft, a first impeller mounted on the shaft associated with a first stage area, a second impeller mounted on the shaft associated with a second stage area, a first bearing assembly for rotatably supporting the first impeller, a second bearing assembly for rotatably supporting the second impeller, at least one flow path for permitting fluid being pumped by the pump to flow in the housing such that it provides lubrication for the first and second bearing assemblies.

Other objects and advantages of the invention will be apparent from the following description, the accompanying drawings and the appended claims.

DETAILED DESCRIPTION OF THE PREFERRED EMBODIMENTS

Figure 1:
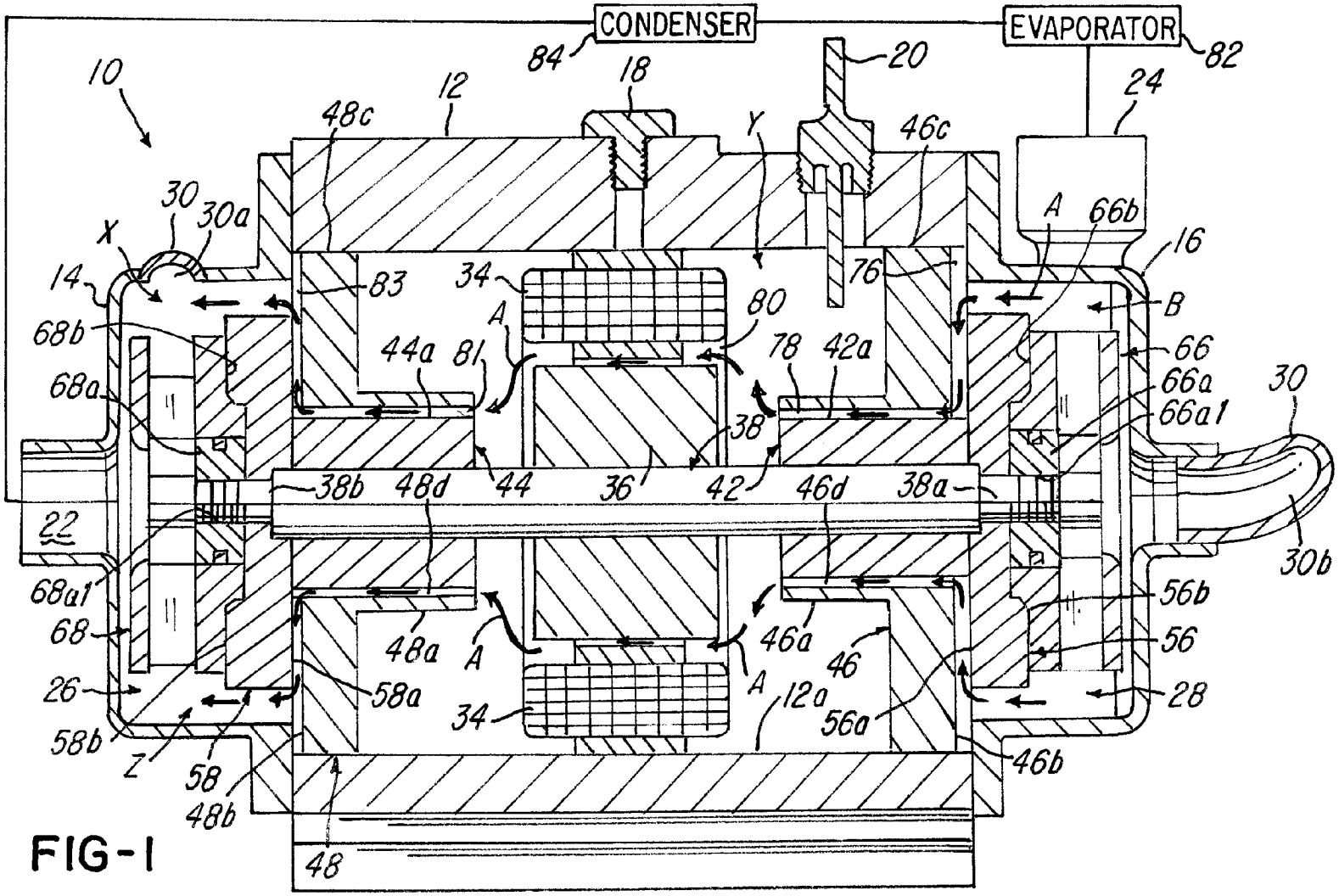
FIG. 1 is a sectional view of a pump in accordance with one embodiment in the invention.
Figure 2:
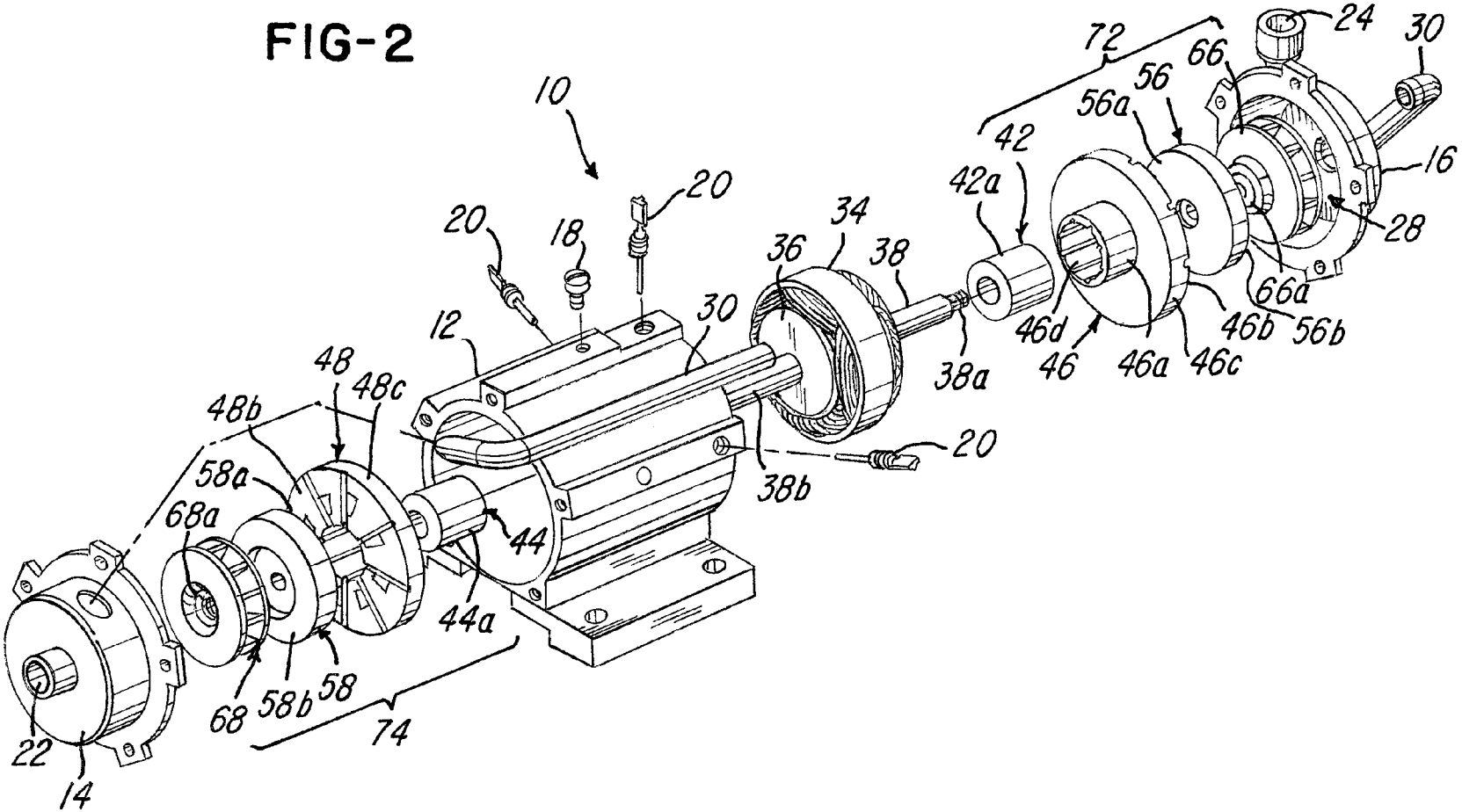
FIG. 2 is an exploded view of the pump shown in FIG. 1.
Figure 4:
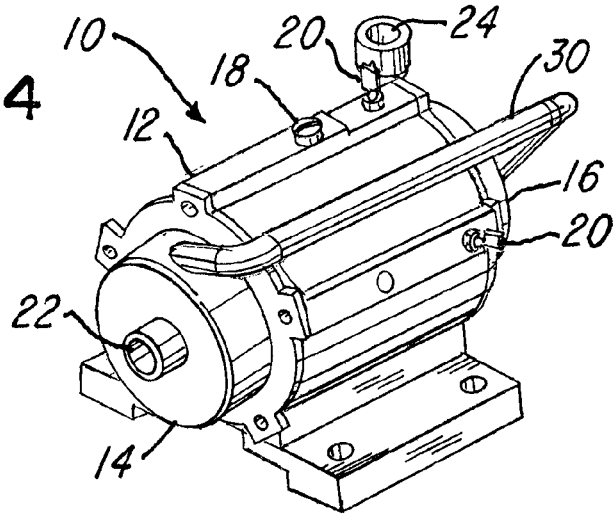
FIG. 4 is an assembled view of the pump shown in FIG. 1.
Figure 5A:
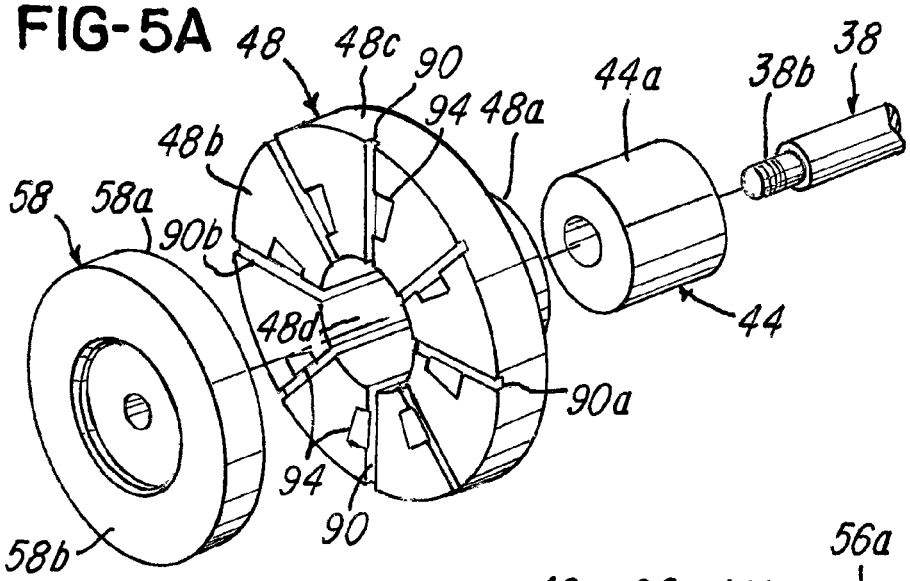
FIG. 5A is an exploded view of various bearings used in the pump.
Figure 5B:
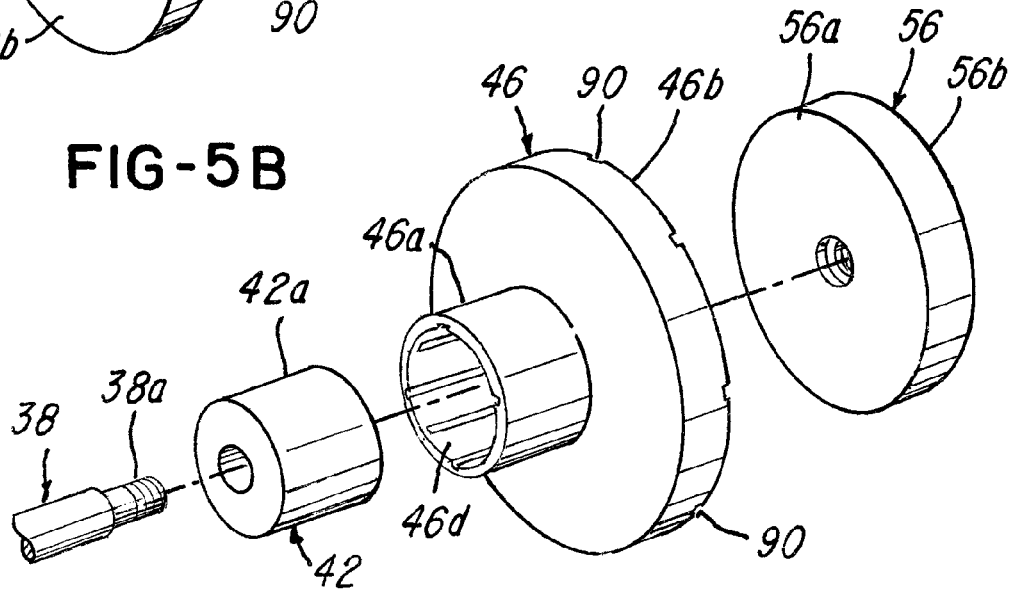
FIG. 5B is another exploded view of various bearings used in the pump shown in FIG. 1.

Referring now to FIGS. 1, 2 and 4, a pump in accordance with one embodiment of the invention is shown. In this embodiment, the pump 10 comprises a housing, a first end cap 14 and a second end cap 16. The pump 10 comprises a stator 34 and rotor 36 mounted on a shaft 38. The rotor 36 and stator 34 cooperate to provide an electric motor. A motor locking screw nut 18 is provided in a housing wall 12*a* for locking the electric motor inside the housing 12 in a manner conventionally known. The housing 12 further comprises at least one or a plurality of hermetic connectors 20 in wall 12*a* which are also conventionally known.

The pump 10 comprises an inlet 22 and an outlet 24. The inlet 22 is in fluid communication with a first stage area 26, and the outlet 24 is in fluid communication with a second stage area 28. The first and second stage areas 26 and 28 are fluidly connected by a tubular member 30 (FIG. 2).

The pump 10 (FIG. 1) further comprises a first stationary journal bearing 46 and a second stationary journal bearing 48 that are mounted to a housing wall or inner surface 12*a* of the housing 12. The journal bearings 46 and 48 comprise a first portion or projection 46*a* and a second portion or projection 48*a*, respectively, both of which are generally cylindrical. The bearing 46 comprises a generally planar surface 46*b* and the bearing 48 comprises a generally planar surface 48*b*, as illustrated in FIG. 2. In the illustration being described, the bearings 46 and 48 comprise an outer cylindrical wall or surface 46*c* and 48*c*, respectively, that are conventionally mounted to wall 12*a* of the housing 12. In the illustration being described, the surfaces 46*c* and 48*c* are press fit to the wall 12*a* to provide a fluid-tight seal between the bearings 46 and 48 and the inner surface 12*a* of the housing 12.

The projections 46*a* and 48*a* comprise an inner wall 46*d* and 48*d*, respectively that define a first sleeve bearing receiving area 49 and second bearing receiving area 51. Note that the first and second sleeve bearing receiving areas 49 (FIG. 7B) and 51 (FIG. 6B) are adapted to receive a first generally cylindrical sleeve bearing 42 and a second generally cylindrical sleeve bearing 44, respectively. When the generally cylindrical sleeve bearings 42 and 44 are received in the respective areas, the surfaces 42*a* and 44*a* become generally opposed in an operative relationship with the wall 46*d* and 48*d*, respectively. Note that sleeve bearings 42 and 44 can be of plain cylindrical, Tapered Land, Rayleigh step, etc.

The pump 10 further comprises a pair of thrust bearings 56 press fit, mounted, slid or situated on shaft 38. The thrust bearings 56 and 58 comprise a generally planar surface 56*a*, 56*b*, respectively, as shown in FIGS. 1 and 2. Note that the thrust bearing 56 is mounted on a first end 38*a* of shaft 38 and an adjacent first impeller 66. The thrust bearing 58 is mounted on a second end 38*b* of the shaft 38 and adjacent second impeller 68. The first and second impellers 66 and 68 have internal sleeves 66*a* and 68*a*, respectively, and comprise an inner diameter or surface 66*a*1 and 68*a*1, respectively, for mounting on the ends 38*a* and 38*b* of shaft 38 as shown. Although not shown, the ends 38*a* and 38*b* may be serrated to facilitate mounting and retaining the impellers 66 and 68 thereon in a manner conventionally known.

The thrust bearing 56 comprises a side or surface 56*b* (FIGS. 1 and 2) that mates with a rear surface 66*b* of impeller 66 and impeller 68 has a surface 68*b* that mates with a side or surface 58*b* of the second thrust bearing 58. In this illustrative embodiment, the thrust bearings 56, 58 provide a mating rear face of each impeller 66 and 68 and rotate therewith. It should be appreciated that the impellers 66 and 68 may be integrally formed or machined and adapted to provide the surfaces 56*a* and 58*a* of thrust bearings 56 and 58 described later herein. The various bearings 42, 44, 46, 48 and 58 and features thereof will be described later herein relative to FIGS. 5A-5B, 6A-6B, 7A-7B and 8A-8B.

As illustrated in FIG. 1 and as described in more detail later herein, it should be understood that the pump 10 permits at least a portion of the fluid that is being pumped to be directed within the housing 12 to lubricate at least one or a plurality of bearings in the pump 10, while substantially simultaneously working to cool the motor in the pump 10. In this regard, fluid is provided at inlet 22 and when a current (not shown) from a power source (not shown) energizes the electric motor, the shaft 38 rotates impeller 68 which in turn pressurizes the fluid in the first stage area 26 to a first predetermined pressure. The fluid moves through the tubular member 30 (FIGS. 2, 4) and into the second stage area 28 whereupon impeller 66 pressurizes the fluid to a second predetermined pressure, which is higher than the first predetermined pressure. A portion of the fluid in the second stage area 28 exits the outlet 24 to an evaporator 82 (FIG. 1) and then to a condenser 84. Thereafter, the fluid returns to the inlet 22 as shown.

At least a portion of the fluid is directed internally from the second stage area in the direction of arrow A (FIG. 1) and to the area 76 between the face or surface 56*b* of thrust bearing 56 and the surface 46*b* of stationary journal bearing 46. The fluid flows into the area 78, which is the area between the surface 46*d* of the portion 46*a* of journal bearing 46 and the surface 42*a* of the sleeve bearing 42. The fluid flows into the motor chamber Y and passes between the rotor 36 and stator 34 as shown. The fluid ultimately enters into an area 81, which is an area between the surface 48*d* of portion 48*a* of stationary journal bearing 48 and a surface 44*a* of the rotating sleeve bearing 44. The fluid exits area 81 and flows into the area 83, which is an area between the surface 58*a* of thrust bearing 58 and surface 48*b* of the stationary sleeve bearing 48. The area 83 is in fluid communication with the first stage area 26.

It should be understood that the pump 10 in accordance with the embodiment being described permits an external flow loop or cycle whereupon the pump 10 pumps fluid to perform work and an internal flow loop or cycle wherein the pump 10 causes at least a portion of the fluid to flow in the path or direction of arrow A (FIG. 1) to lubricate at least one or a plurality of bearings in the pump 10, while substantially simultaneously cooling the electric motor in the pump 10. Thus, it should be understood that at least a portion of the fluid that is being pumped by pump 10 to perform work externally of the pump 10 is the fluid that is performing the mentioned lubricating and cooling.

Figure 3:
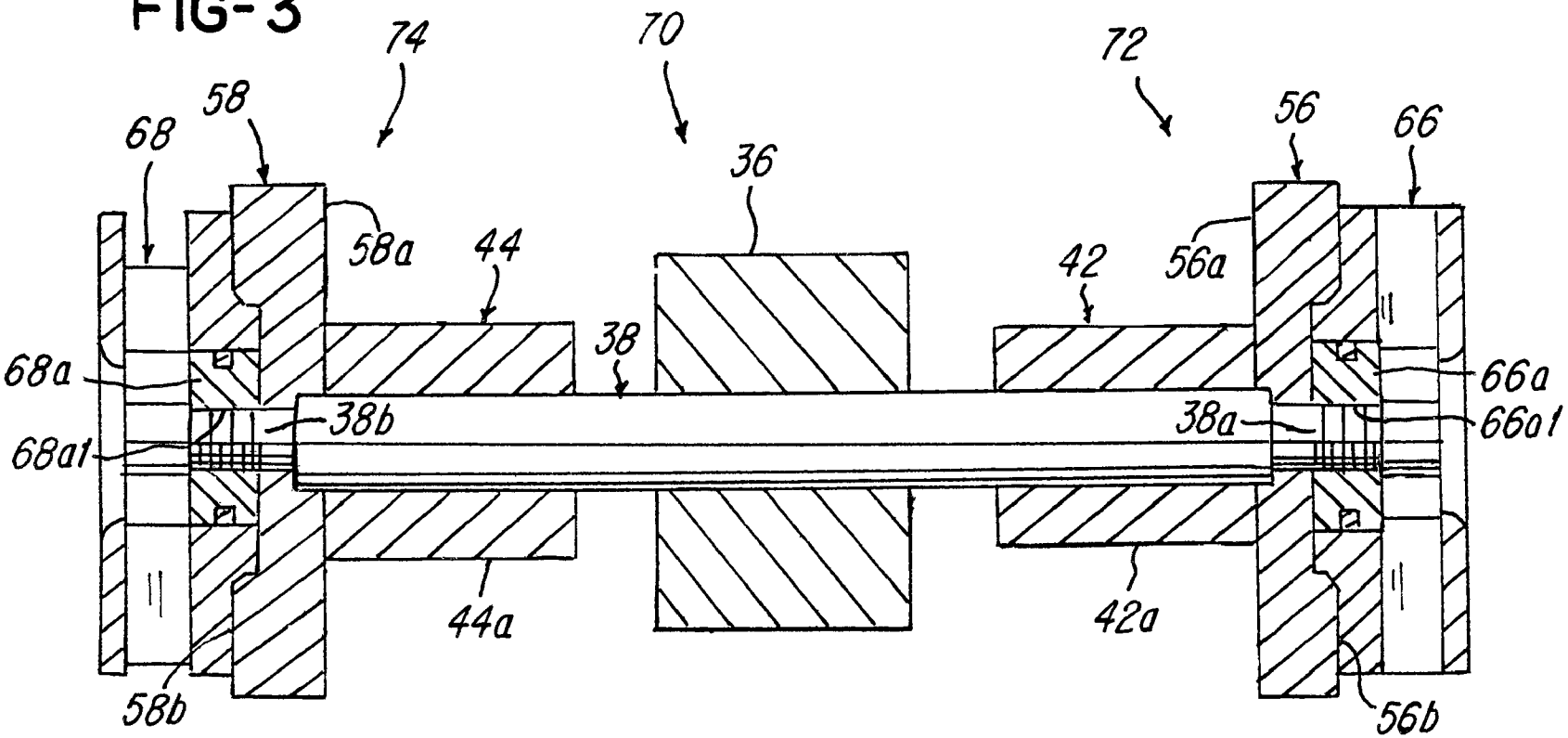
FIG. 3 is a sectional view of a rotating assembly used in the pump shown in FIG. 1.

Referring now to FIG. 3, a view of a rotating assembly 70 of the rotating parts is shown for ease of understanding and illustration. The rotating assembly 70 comprises the shaft 38 and rotor 36, a first rotating assembly of components 72 and a second rotating assembly of components 74. The first rotating assembly of components 72 comprises the sleeve bearing 42, the thrust bearing 56 and impeller 66, all of which are mounted on the shaft 38 by a press fit or shrink fit. In the embodiment being illustrated, the sleeve bearings 42 and 44 are press or shrink fit onto the shaft 38 and thrust bearings 56 and 58 are slid onto the shaft. The impellers 66 and 68 have internal threaded surface 66*a*1 and 68*a*1, respectively that are threadably mounted onto ends 38*a* and 38*b* and provide means for retaining the thrust bearings 56 and 58 on the shaft 38. As mentioned earlier herein, the impeller 66 comprises the sleeve 66*a* having the inner diameter or surface 66*a*1 adapted to be received on the splined end 38*a* of shaft 38.

The rotating assembly 74 comprises the sleeve bearing 44, thrust bearing 58 and second impeller 68, all of which are mounted on the shaft 38. As with the first impeller 66, the impeller 68 also comprises a sleeve 68*a* that has a splined inner diameter surface 68*a*1 adjacent to be received on a splined end 38*b* of the shaft 38. The rotating assembly 70 is mounted within the housing 12 such that the rotor 36 is mounted in operative relationship with the stator 34 so that when a current from a power source (not shown) is applied to be windings (not shown) in a manner conventionally known, the rotor 36 and stator 34 cooperate to rotatably driving the shaft 38.

Notice that the assemblies 72 and 74 are adapted to provide at least one hydrodynamic lubricating channel or passageway enabling fluid lubrication of at least one or all of the bearings within the assemblies 72 and 74 and housing 12. In this regard, notice that the surface 56*b* of thrust bearing 56 generally opposes and cooperates with surface 46*b* of stationary bearing 46 (FIG. 1) to define the fluid receiving area 76 mentioned earlier. Notice also that an outer surface 42*a* of sleeve bearing 42 cooperates with the inner wall or surface 46*d* of portion 46*a* of stationary bearing 46 to define the fluid passageway 78, with passageway 80 being in fluid communication with the passageway 78. Likewise, surface 58*b* of thrust bearing 58 cooperates with the face or surface 48*b* of stationary bearing 48 to define the fluid passageway 83, as illustrated in FIG. 1. The sleeve bearing 44 comprises the outer surface 44*a* that cooperates with inner surface 48*d* of portion 48*a* of stationary bearing 48 to define the fluid pathway 81 as shown.

Thus, it should be understood that the thrust bearings 56, 58, stationary bearings 46, 48 and sleeve bearings 42 and 44 are adapted and cooperate to define at least a portion of the fluid path indicated by arrow A in FIG. 1 to facilitate or enable fluid to flow from the area 28 along the path indicated by arrow A (FIG. 1), past the first rotating assembly 72 (FIG. 2), between the rotor 36 and stator 34 (FIG. 1), past the second rotating assembly 74 and ultimately into first stage area 26, as illustrated in FIG. 1. The fluid flows from the area 28 back to the area 26. This enables the fluid to not only cool the electric motor, but to also lubricate at least one or a plurality of bearings in the pump 10. It should be understood that only a portion of the fluid that is caused to be pumped from the first stage area 26, through the tubular member 30, and to the second stage area 28 is permitted to flow from the second stage area 28 back to the first stage area 26, while a majority, such as approximately 50% or even as high as 90% or more of the fluid is pumped though the outlet 24 of the pump 10. Advantageously, the hydrodynamic operation facilitates reducing or eliminating the need for mechanical bearings of the type used in the past while substantially simultaneously cooling the electric motor in the pump.

Referring back to FIG. 1, notice that the outlet 24 is coupled to the evaporator 82 or a component for performing work, which in turn may be coupled to a condenser 84 which returns the fluid back to the inlet 22 of the pump 10. The means and apparatus for creating the fluid path will now be described.

In the illustration being described, at least one or a plurality of the stationary bearings 46, 48 or the thrust bearings 56, 62 comprise at least one or a plurality of channels 90 (FIGS. 5A-5B, 6A-6B, and 7A-7B) for directing fluid in a manner such that they hydrodynamically lubricate at least one of those bearings or the sleeve bearing 42 and 44 in the pump 10 and further facilitate or enable fluid to flow between the second stage area 28 and the first stage area 26, as mentioned earlier herein. In one illustrative embodiment, the plurality of channels, conduits, grooves or passageways 90 are illustrated in FIGS. 5A-5B and 6A-6B. For ease of description, the channels, conduits, grooves or passageways 90 will be referred to as "passageways" and they will be described relative to the first rotating assembly 72, but it should be understood that the features being described apply to like components of the second rotating assembly 74 as well.

Notice that each of the passageways 90 (FIG. 5A) comprises an opening or inlet 90*a*, a radial passageway or channel portion 90*b*, and passageway or channel portion 90*c*. The radial passageway or channel 90*b* is in fluid communication with the axial passageway or channel 90*c* to define the passageway 90.

Figure 6A:
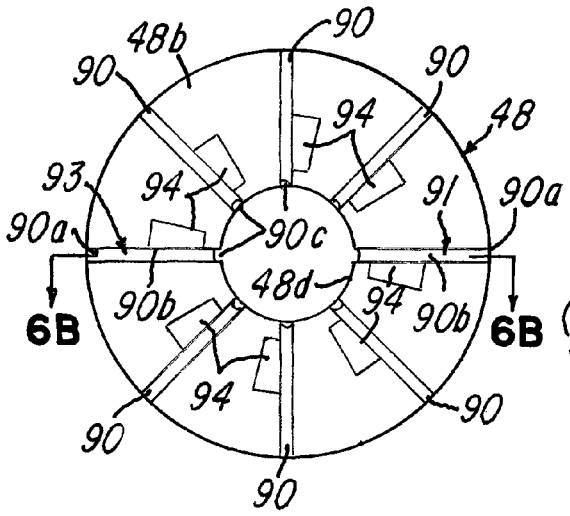
FIGS. 6A-6B are various views of a stationary bearing used in the pump in FIG. 1, with FIG. 6B being a sectional view taken along line 6B-6B in FIG. 6A.
Figure 6B:
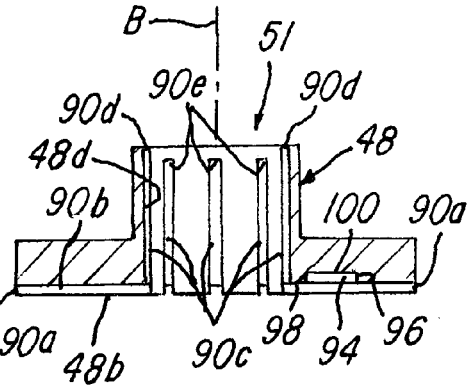

An optional fluid reservoir 94 may be provided or machined into the face or surface 46*b* (FIG. 7A) of the bearing 46 and in fluid communication with at least one of the passageways 90 to provide a reservoir for receiving and storing fluid to facilitate lubricating the interface or area 76 between the surface 46*b* and the surface 56*b* (FIG. 8A) of the thrust bearing 56. As best illustrated in FIGS. 6A and 6B, notice that the reservoir 94 is defined by a first wall 96, a second wall 98 and a surface 100 as shown in FIGS. 6A and 6B. Although not shown, it should be understood that more or fewer reservoirs 94 may be provided or even a smaller and/or larger reservoir provided in fluid communication with each passageway 90. Alternatively, no reservoirs 94 may be provided if, for example, the passageways 90 are adapted to have a dimension that permits enough fluid to hydrodynamically lubricate the interface between the stationary bearing 46 (FIG. 7A) and the thrust bearing 56 (FIG. 8A).

As mentioned earlier, each of the passageways 90 comprises a first leg or radial passageway or conduit 90*b* in surface 46*b* and a generally axial passageway or conduit 90*c* in wall 46*d* as shown. Notice that one or more of the axial passageways 90*c* may extend through the entire axial length of the surface 46*d* of the portion 46*a* of the bearing 46. This facilitates fluid traveling into the inlet 90*a*, through the passageway 90*b*, along the passage where conduit or channel 90*c* and out through outlet opening 90*d* (FIG. 6B) is shown. Some of the axial channels, conduits or passageways 90*c* may comprise a wall 90*e* that provides a closed end (FIG. 6B) of passageway 90*c*. The closed end causes fluid to be captured in the axial passageway 90*c*, to facilitate providing a lubricating film of fluid in the area 78 and between bearings 42, 46 and 56, thereby providing hydrodynamic lubrication in the area 78 between the inner wall surface 46*d* and the surface 42*a* of sleeve bearing 42 and between surface 44*a* of bearing 44 and surface 48*d* for the second rotating assembly 74.

Figure 7A:
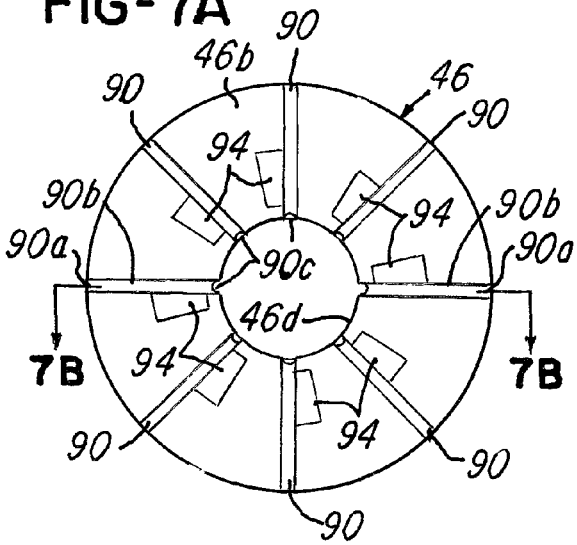
FIGS. 7A-7B are various views of another stationary bearing, similar to the bearing shown in FIGS. 6A-6B with reservoirs being located in a different position than the position shown in FIGS. 6A-6B and with FIG. 7B being a sectional view taken along line 7B-7B in FIG. 7A.

Notice in FIG. 7A that each of the reservoirs 94 is situated along a common circumference about an axis B (FIG. 7B) of the bearing 46. Alternatively, the reservoirs may be staggered so that they are positioned at different radial distances from the axis B. As mentioned earlier, more or fewer reservoirs 94 may be provided or they may be larger or smaller and their respective sizes may vary depending on the amount of lubrication desired. It should also be understood that one or more reservoirs 94 may be provided in fluid communication with the axial passageway 90*c* if desired. Further, it should be understood that one or more circumferential passageways (not shown) may connect the reservoirs 94 or the passageways 90*b*. For example, a circumferential channel, like channel 212 (shown in the embodiment in FIG. 19A), may be provided that connects one or more of the plurality of passageways 90*b*. Thus, one or more circumferential channels may be provided to provide fluid communication between or among the passageways 90*b* or 90*c*.

Although not shown, the passageways 90*b* have been illustrated as being generally radial relative to the axis B (FIG. 7B) of the stationary bearing 46, however, they could be slanted, spiral, helical or other shape in order to facilitate lubricating and directing fluid from the radial direction illustrated in FIG. 1 to a generally axial direction as illustrated in FIG. 1. Moreover, the inlets 90*a* may be adapted, configured or shaped to facilitate forcing or "scooping" fluid into the passageways 90.

The channels 90*c* are illustrated as being generally parallel to the axis B, but they could be oriented in a helical, spiral, slanted or other configuration or otherwise adapted to facilitate provided a hydrodynamic lubrication at the interface or area 76 and to facilitate directing fluid from the second stage area 28 to the first stage area 26.

As with the fluid inlet 90*a*, the fluid outlet 90*d* may be adapted or configured to facilitate the flow of the fluid through the fluid channel, conduit or passageway 90.

Referring now to FIG. 8A, notice that the thrust bearing 56 comprises the surface face 56*b*, which is generally planar in this embodiment. Notice that the thrust bearing 56 has a receiving area 110 that is defined by a wall 56*c* having a portion 56*d* (FIG. 8B) that is frusto-conical in cross section. The wall 56*c* of bearing 56 cooperates with a surface 56*e* to define the area 110 which generally complements and is adapted to receive and mate with a male projection portion or rear surface 66*b* (FIG. 2) of the impeller 66. In this regard, the internal sleeve 66*a* of impeller 66 may comprise female threaded apertures (not shown) for receiving a threaded end of shaft 38. After mating, the surface 56*b*, in effect, provides a rear face of impeller 66.

The thrust bearing 56 has an inner diameter or wall 56*f* (FIG. 8A) that is slidably and rotatably mounted on the shaft 38. The thrust bearing 56 pilots onto the shaft 38 and is held there by friction from the bolted connection of the shaft 38 and impeller 66. The thrust bearing 56 further comprises a notched-out area 106 defined by the cylindrical wall 56*g*. As illustrated in FIG. 1, the notched-out area 106 receives a portion 38*c* of shaft 38.

In the illustration being described, the surface 56*b* of the thrust bearing 56 is in cooperative and generally opposed relationship and faces the surface 46*b* of the stationary journal bearing 46, as illustrated in FIG. 1. As fluid flows in the direction of arrow A and into the area 76, it provides a hydrodynamic film of lubrication between the face 46*b* and the surface 56*b*. Notice also that each of the inlets 90*a* of each of the plurality of channels 90 receive fluid and direct it into the passageways 90*b*. For those channels 90 having the axial channels 90*c* that are closed by wall 90*e*, the passageways 90*c* further facilitate storing fluid and providing a film of hydrodynamic lubrication between the surface 46*d* of the stationary journal bearing 46 and the surface 42*a* of the sleeve bearing 42. Those channels, such as channels 91 and 93 (FIG. 6A), that have the channel areas 90*c* that are not closed permit or enable fluid to flow from the second stage area 28 in the radial direction along the face 46*b* and then in an axial direction and into the area Y as illustrated in FIG. 1. It should be understood that the stationary journal bearing 48 and thrust bearing 58 comprise substantially the same configuration as the stationary journal bearing 46 and thrust bearing 56, respectively, illustrated in FIGS. 7A and 7B, and those parts or features bearing the same part number are substantially the same.

Figure 7B:
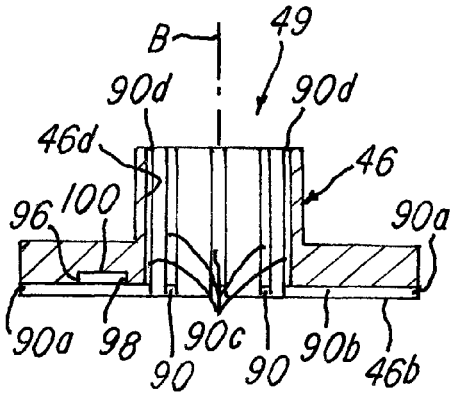
Figure 8A:
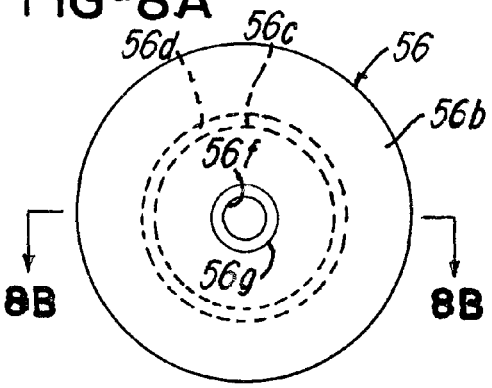
FIGS. 8A-8B are various views of a thrust bearing in accordance with one embodiment of the invention, with FIG. 8B being a sectional view taken along line 8B-8B in FIG. 8A.
Figure 8B:
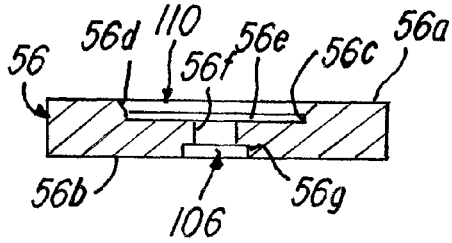

One difference between the bearing 46 illustrated in FIGS. 7A and 7B and the bearing 48 illustrated in FIGS. 6A and 6B is that the reservoirs 94 are situated on the left or opposite side (as viewed in FIG. 7A) of the channel 90*b* portion of each of the channel portions 90*b* of passageway 90 as shown. In one embodiment, it is desired to have the reservoirs 94 downstream of the respective passageway 90*b* to facilitate storage of fluid to which they are in fluid communication. Consequently, the position and location of reservoirs 94 on the bearing 46 in FIG. 7A may be desired when the bearing 46 is rotating in a counter clockwise direction, whereas the reservoir 94 located on bearing 48 illustrated in FIG. 6A may be preferred when utilized with bearing 48 that is rotating in a clockwise direction, as viewed in FIG. 6A.

During operation, the pump 10 receives fluid in the inlet 22 and impeller 68 pumps the fluid from the first stage area 26 to a first predetermined pressure to cause the fluid to flow through the tubular member 30 and into the second stage area 28. At the second stage area 28, the second impeller 66 pumps the fluid and pressurizes the fluid to a second predetermined pressure level, which is higher than the first predetermined pressure of the fluid in the first stage area 26. At least a portion of the fluid travels into the area 76 and into the inlets 90*a* of the passageways 90, through the passageways channels 90*b* and into the passageways 90*c*. For those channels 90*c* that are not closed, the fluid is permitted to pass into the area Y (FIG. 1) and between the rotor 36 and the stator 34, which facilitates cooling these components.

The fluid then passes into the area or interface 81 between the sleeve bearing 44 and stationary journal bearing 48. As the fluid travels between the surface 48*d* and the surface 44*a* of the sleeve bearing 44, the fluid provides a hydrodynamic film of lubrication between these components and their surfaces. The fluid travels through the interface or area 81 and in the interface or area 83 and into the passageway, conduit or channel 90*c* of each of the passageways 90 to provide hydrodynamic lubrication between the surface 48*b* and the surface 58*a* as shown. For those portions or passageways 90*c* that are not closed at their ends by the wall 90*e*, the passageway permits the fluid to exit out of the outlet 90*d* of the passageway 90 and back into the first stage area 26.

Advantageously, the pump 10 provides a system and method for cooling the electric motor in the pump 10 and substantially simultaneously provides a hydrodynamic fluid lubricant to the rotating assembly 70 in the pump 10 in a manner that provides lubrication to a least one or a plurality of bearings in the pump 10. It should be understood that the lubricant or fluid providing the hydrodynamic lubrication is the same fluid that is being pumped by the pump 10. As mentioned earlier, the system and method of the embodiment being described, facilitates using at least a portion of the fluid that is being pumped by the pump 10 for both cooling and lubricating in the manner described herein.

It should be understood that the lubricant in the embodiment being described is a refrigerant, such as refrigerant R134a available from DuPont Fluoro Chemicals of Wilmington, Del. Other refrigerants or lubricants may be used, such as R-123, R-22, R-410A, Dow's Syltherm HF, Shell's Diala AX, or any low (near 1 cP) viscosity fluid.

Figure 9:
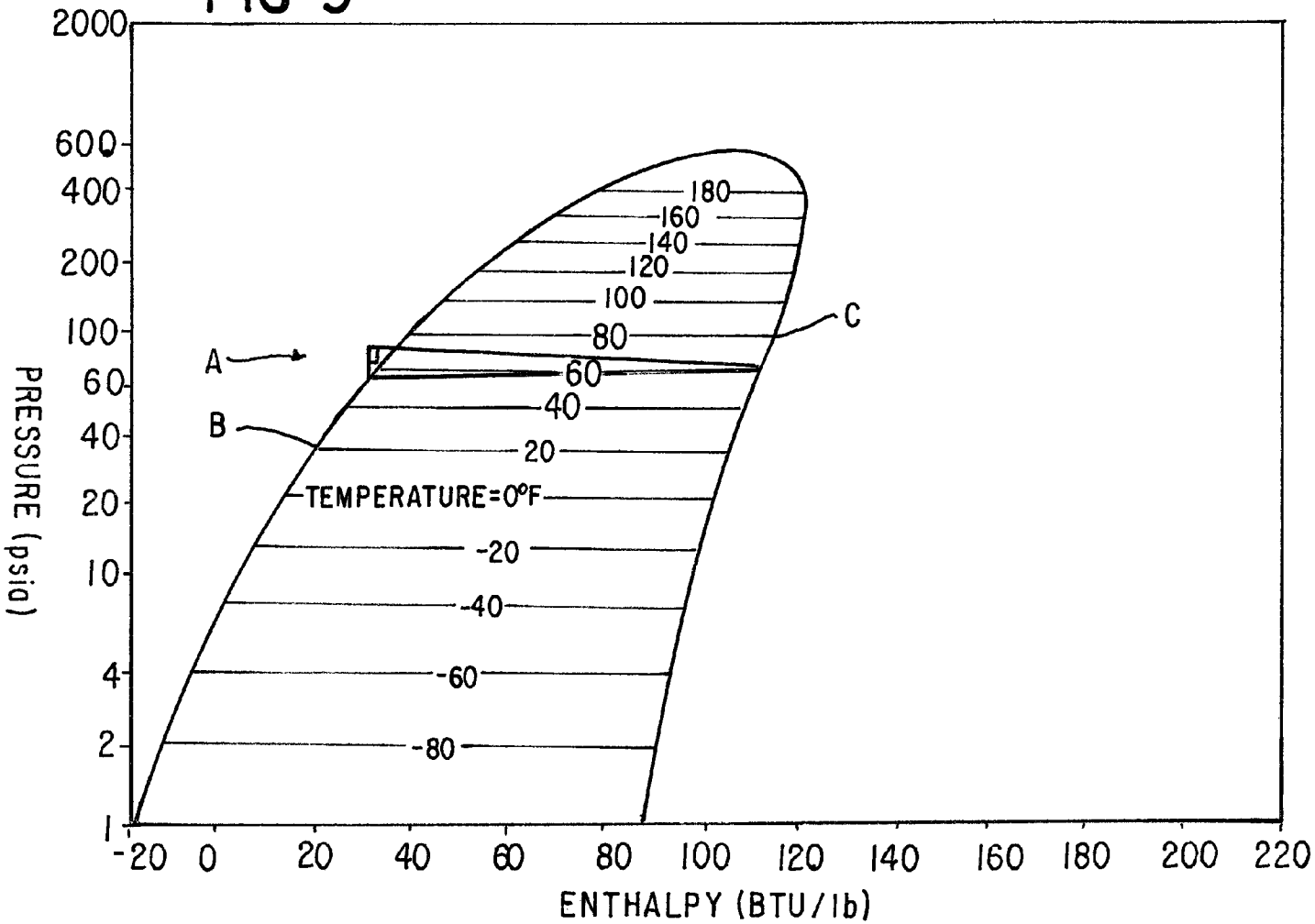
FIG. 9 is a view of an enthalpy diagram.

Referring now to FIG. 9, a pressure-enthalpy diagram is provided showing in English units the enthalpy curve for the HFC-134a refrigerant available from DuPont Fluorochemicals of Wilmington, Del. In general, the enthalpy curve shows an area A at which the fluid is in liquid state, a curve B at which the liquid becomes saturated and a portion of the curve C where the fluid becomes a saturated vapor. As is known, to the right of the portion C, the fluid is a vapor and to the left of the curved portion B the fluid is a liquid. In the illustration being described, the pump 10 provides two phase cycles and sub-cools the fluid used for lubrication and cooling in a manner that will now be described relative to FIGS. 9-11.

Figure 10:
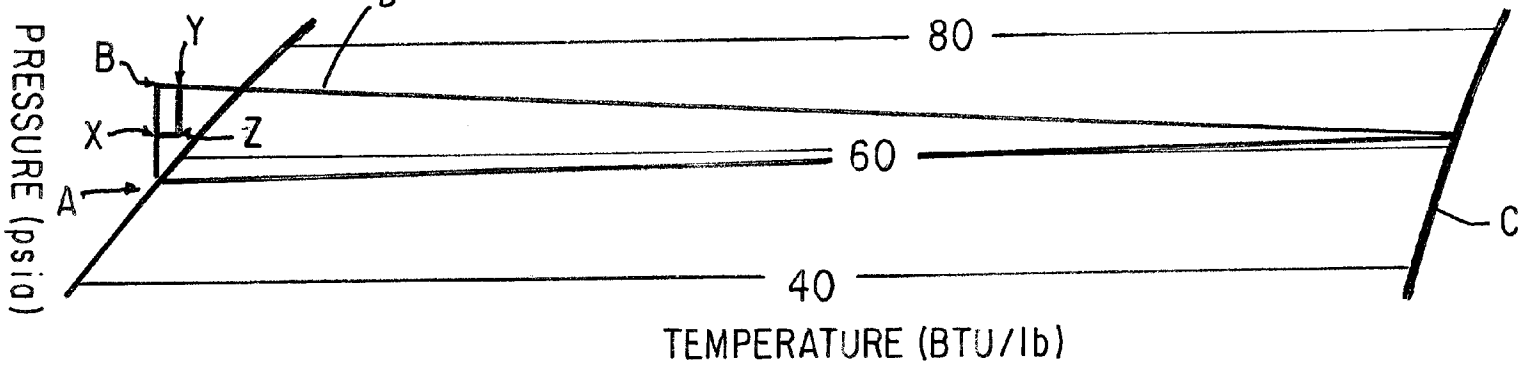
FIG. 10 is an enlarged view of then enthalpy diagram shown in FIG. 9 illustrating an external diagram or cycle.

Notice in FIGS. 9 and 10 that a first external cycle or phase is illustrated by the circuit or diagram D, which is best illustrated in the enlarged view of FIG. 9. In this circuit, the fluid travels outside the pump 10 and is pumped by the pump 10 to the evaporator 82 (FIG. 1), condenser 84 and then ultimately back to the inlet 22. In this external loop, represented by the circuit D (FIG. 10), the fluid starts at the pump inlet 22 (which is indicated by point A in the circuit D in FIG. 10) and progresses to point B as a result of a pressure increase due to the rotating impeller 68. The fluid is transported through the tubular member 30 to the second stage area 28 where it again undergoes a pressure increase caused by impeller 66. Ultimately, the fluid reaches the pressure indicated by point B on the circuit D which corresponds to the second predetermined pressure at the second stage area 28 of the pump 10. The fluid travels out of the outlet 24 (FIG. 1) of the pump 10 and into the evaporator 82 where it undergoes a temperature rise as indicated by the diagram D (FIG. 10), whereupon fluid undergoes evaporation. As the fluid condenses in the condenser 84, it moves from state indicated back to the left (as viewed in FIG. 10), whereupon the cycle begins again as the fluid returns to the inlet 22 of the pump 10.

A second loop or internal cycle is indicated by arrow A in FIG. 1 and as mentioned earlier, provides cooling for the electric motor in the pump 10, as well as lubrication for at least one or a plurality of the bearings mentioned earlier herein. It should be understood that the fluid in this cycle is and remains sub-cooled throughout the cycle as will now be described.

Figure 11:
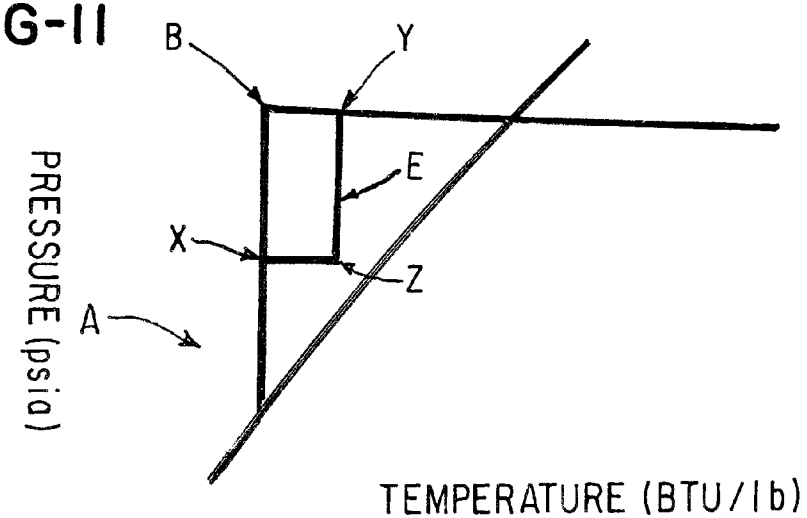
FIG. 11 is an enlarged view of a portion of the enthalpy diagram shown in FIG. 9 illustrating an internal cycle.

This loop is generally represented by a vertical rectangular box indicated by the circuit or diagram E in FIG. 11. In general, fluid flows from the inlet 22 into the first stage area 26, through tubular member 30 and the second stage area 28 and then in the direction of arrow A (FIG. 1) back to the first stage area 26 in the manner described earlier herein. The second loop or phase diagram E for the fluid which is used to cool the pump 10 and electric motor and to lubricate at least one or a plurality of bearings, is defined by the points X, B, Y and Z in the diagram E shown in FIG. 11. As mentioned earlier, this loop is where a part of the main fluid stream is diverted from the second stage area 28 of the pump 10 and back into the first stage area 26 to cool the electric motor and to lubricate at least one or a plurality of the hydrodynamic bearings in the pump 10.

The fluid begins at the second stage impeller exit area 28 (which corresponds to point B on the diagram E) and passes the first rotating assembly 72 (FIG. 3) comprising the rotating bearings 42 and 56 into the area Y whereupon the fluid begins to pick up heat from the electric motor. The fluid moves past the rotor 36 and stator 34 and through the second rotating bearing assembly 74 comprising the rotating bearings 44 and 58. As with the flow through the components of the first rotating assembly 72, the fluid passes into the inlets 90*a* of passageways 90 whereupon it flows in passageway 90*b* in a generally radial direction (as viewed in FIG. 1), in an axial direction in passageway 90*c* and into the first stage area 26, where it mixes with the incoming fluid being received in the inlet 22. This causes the fluid to move from point B (FIG. 11) on the diagram E to point Y.

As the fluid mixes with the incoming cooler fluid in the first stage area 26 the fluid crosses an intentional flow control barrier to point Z whereupon the fluid begins to mix with the fluid in the first stage area 26. As the heated and returned fluid mixes with the main fluid being received in the inlet 22 of the pump 10, the temperature of the returned fluid in the internal second loop cools back to the main process temperature, thereby causing the temperature of the fluid to return or drop (i.e., move to the left in the diagram shown in FIG. 10) to a temperature corresponding to the temperature at point A. Finally, the fluid pressure is moved from the point X to point B in diagram E (FIG. 10) by the first impeller 66 at the first stage area 26 of the pump 10.

Advantageously, one feature of the embodiment being described is that it operates to maintain the fluid in a sub-cooled state so that the fluid which facilitating reducing cavitations and improves heat transfer efficiencies. Also, the sub-cooled fluid allows a more powerful motor to run cooler and more reliably. In this regard, notice that the sub-cooled cycle is represented by the fact that the fluid remains above the saturation line B (and, therefore, in a liquid state) the entire time the fluid moves from the first stage area 26, to the second stage area 28, to the internal area Y and ultimately back to the first stage area 26. As used herein, "sub-cooled" means that the temperature of the fluid, when it is in its liquid state, is lower than the saturation temperature for an existing pressure.

Referring to FIGS. 12-19B, another embodiment of the invention is shown. In this embodiment, like parts are identified with the same part numbers as the embodiment shown in FIGS. 1-11, except that a prime ("') has been added to the part numbers of the same parts in the embodiment shown FIGS. 12-19B.

In general, this embodiment provides for fluid flow passageways on the thrust bearings 204 and 206, as opposed to the stationary journal bearings 46, 48 described earlier herein.

Figure 12:
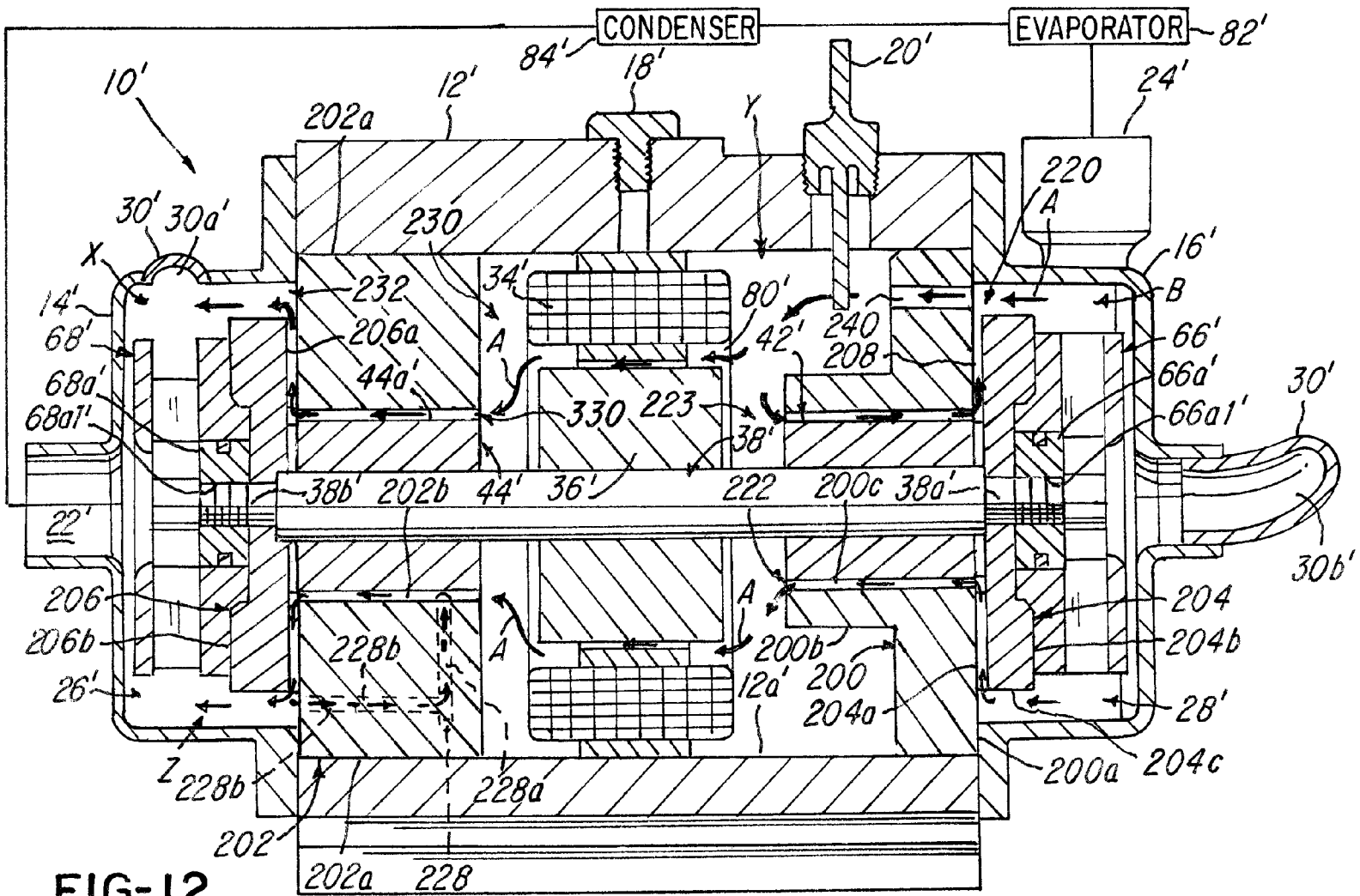
FIG. 12 is a sectional view of a pump in accordance with another embodiment of the invention.

As with the previous embodiment, the embodiment illustrated in FIG. 12 comprises a first stationary journal bearing 200 and a second stationary journal bearing 202. A pair of thrust bearings 204 and 206, are situated on the ends of 38*a*' and 38*b*', respectively, of the shaft 38' as shown and in operative relationship with the bearings 200 and 202, respectively.

Figure 15:
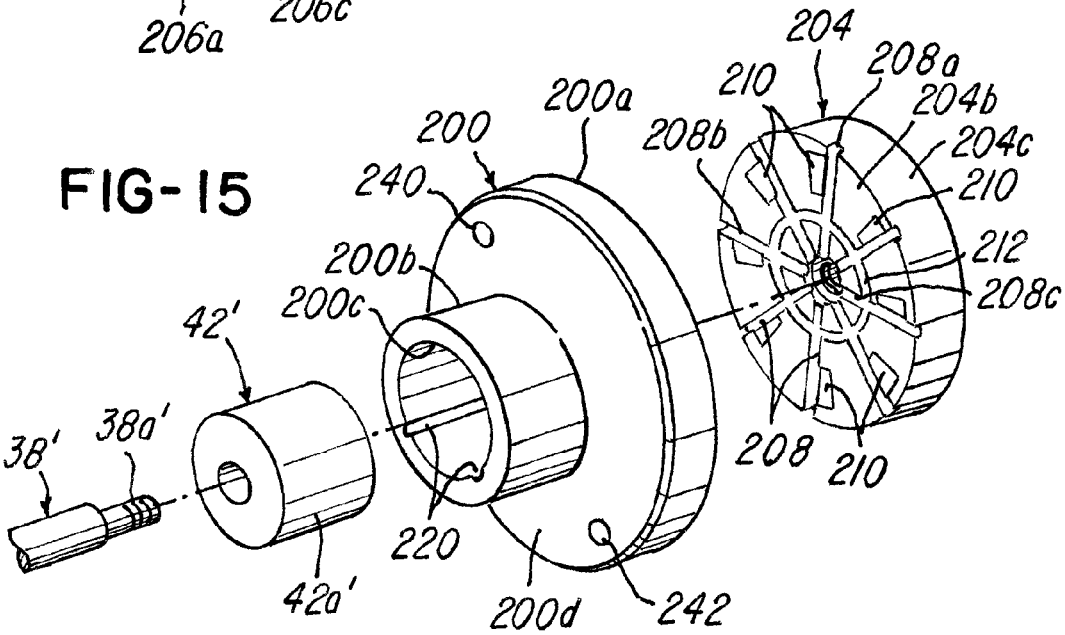
FIG. 15 is another exploded view of various bearings used in the pump shown in FIG. 1.

Unlike the embodiments illustrated in FIGS. 1-11 wherein the plurality of channels 90 are provided in the surface or face of stationary journal bearings 46 and 48, the thrust bearings 204 and 206 comprise passageways, conduits or channels such as plurality of passageways or channels 208. The thrust bearing 204 FIGS. 19A and 19B) in this embodiment comprises a plurality of passageways or channels 208 having an inlet 208*a*, a first channel, portion or area 208*b* which extends generally radially from an axis C (FIG. 18B) of the bearing 204. The channel portion or passageway 208*b* extends generally radially from the inlet 208*a* associated with outer wall 204*c*, through area 208*b*, and to the outlet 208*c* (FIG. 15).

Figure 18A:
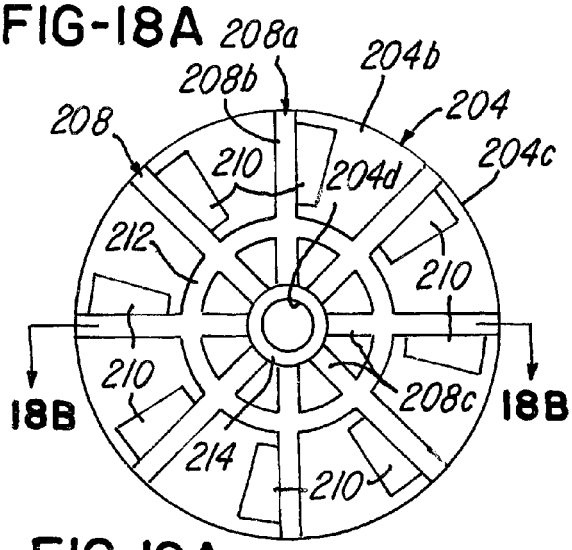
FIGS. 18A-18B are various views of a thrust bearing used in the pump of the embodiment of FIG. 12.
Figure 19A:
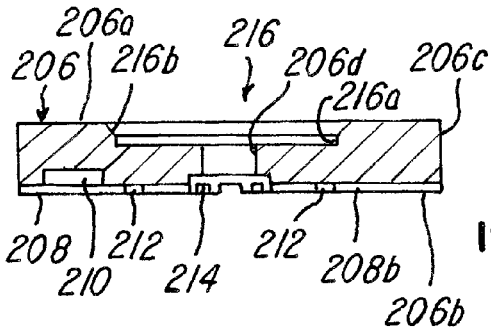
FIGS. 19A-19B are various views are various views of another stationary bearing, similar to the bearing shown in FIGS. 6A-6B with reservoirs being located in a different position than the position shown in FIGS. 6A-6B.
Figure 19B:
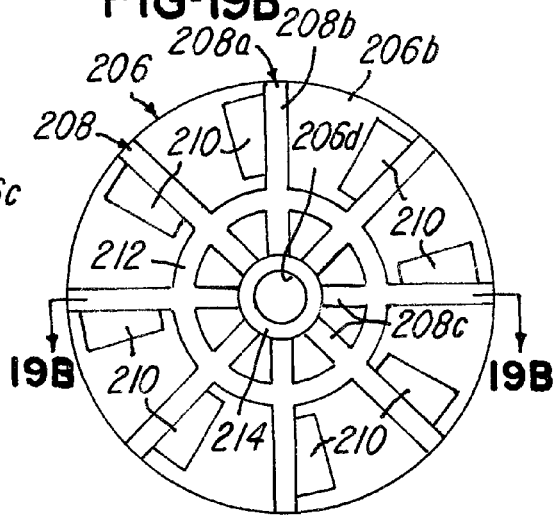
Figure 20:
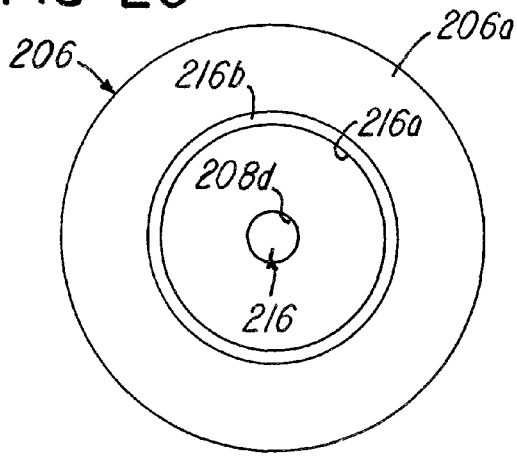
FIG. 20 is a view of a rear side of the thrust bearing shown in FIG. 18A.

Similar to the reservoirs 94 in the illustration shown and described relative to FIGS. 19A and 19B, the bearings 204 and 206 may comprise a plurality of reservoirs 210 that are in fluid communication with at least one or a plurality of the passageways 208*b* as illustrated in FIGS. 18A and 19B. As with the reservoirs 94 described earlier herein relative to FIGS. 6A and 6B, each reservoir 210 may be situated circumferentially downstream of the passageway 208 to which it is in fluid communication as the bearing 204 rotates. Thus, in the embodiment illustrated in FIG. 18A, notice that as the thrust bearing 204 rotates in a counterclockwise direction (as viewed in FIG. 18A), the reservoir 210 tends to pick up and receive fluid flowing into the passageway or channel portion 208*b*.

As shown in FIGS. 18A and 19B, a circumferential or circular passageway 212 may be provided to permit fluid communication between or among one or more of the passageways 208. A second circular circumferential passageway or channel 214 (FIGS. 18A and 19B) is provided adjacent an interior wall or inner surface 204*d* and 208*d* provides further fluid communication between and among the various passageways 208.

Figure 18B:
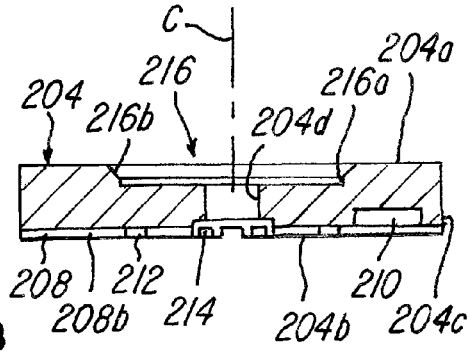

FIGS. 19A and 19B illustrate another thrust bearing 206, which is generally the same as the bearing 204, but which is mounted on end 38*b* of adjacent impeller 68'. One difference between the bearing 204 in FIGS. 18A and 18B compared to the bearing 206 in FIGS. 19A and 19B is the position of the reservoirs 210 which, similar to the embodiment described earlier herein relative to FIG. 7A, are each positioned on a downstream left side (as viewed in FIG. 19B) and in fluid communication with the passageway 208 so that when the bearing 206 rotates in a clockwise direction (as viewed in FIG. 19B), the reservoir 210 may collect and store fluid for providing cooling and lubrication as described earlier herein. The passageways 208 permit and facilitate lubricating the interface between surface 204*b* (FIG. 12) of bearing 204 and generally planar bearing face or surface 200*d* of bearing 200. The passageways 208 and reservoirs 210 may comprise the same or similar characteristics as the passageways 90 and reservoirs 94, respectively, described earlier herein.

Similar to the thrust bearing 56 described earlier herein relative to FIGS. 8A and 8B, notice that the thrust bearings 204 and 206 comprise a receiving area 216 (FIGS. 18B and 19A) that is defined by a wall 216*a* which has a portion 216*b* that is a chamfer or frusto-conical in cross section. As with the area 110 associated with bearing 56 described earlier herein, the area 216 of bearings 204 and 206 is adapted to receive and complement the shape of the male projection portion, such as portion 66*a*' (FIG. 13) of the impeller 66' or 68', respectively.

Referring back to FIGS. 12, 15, 17A and 17B, the first stationary journal bearing 200 comprises a generally cylindrical outer wall 200*a* that is secured to the cylindrical inner wall 12*a*' of housing 12'. The stationary journal bearing 200 further comprises a generally cylindrical portion 200*b* having an inner diameter wall 200*c* and a plurality of channels or grooves 220 (FIGS. 15, 17A and 17B) formed therein. A generally planer bearing face 200*d* is situated in opposed relation to the surface 204*b* of thrust bearing 204. As with the previous embodiment, the plurality of channels, passageways or grooves 220 are generally parallel to an axis D (FIG. 17B) of the stationary journal bearing 200 and permits fluid to flow in the area 222 (FIG. 12) between the wall 200*c* and the outer surface 42*a*' of the sleeve bearing 42'.

Figure 14:
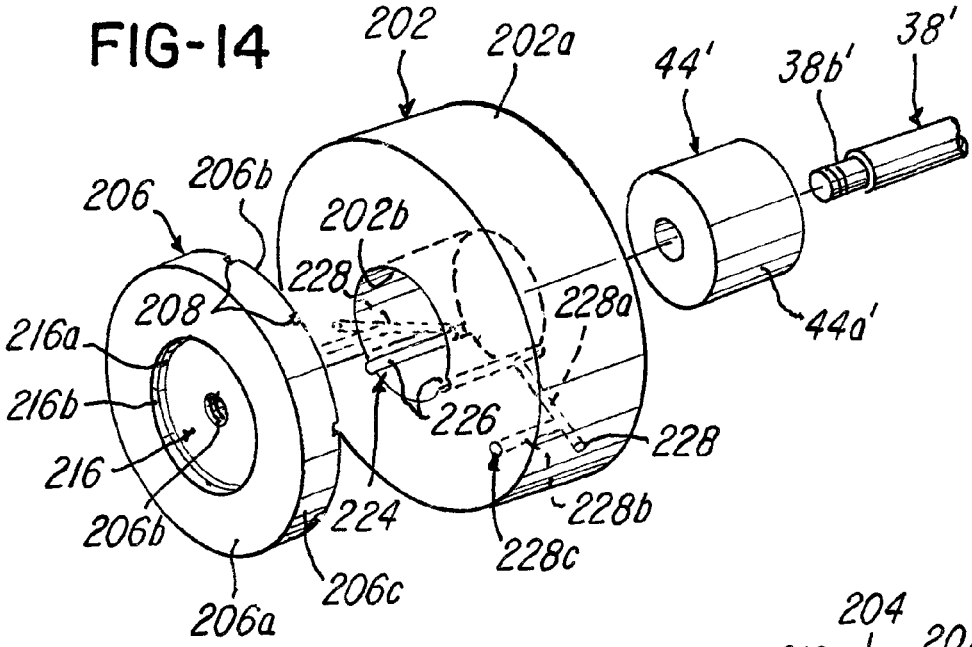
FIG. 14 is an exploded view of various bearings used in the pump.
Figure 16A:
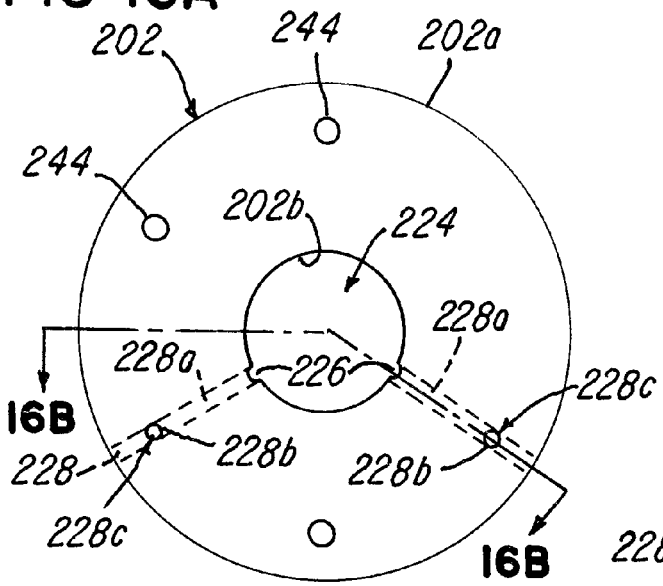
FIGS. 16A-16B illustrate a stationary bearing used in the pump illustrated in FIG. 12 with FIG. 16B being a sectional view taken along line 16B-16B in FIG. 16A.
Figure 16B:
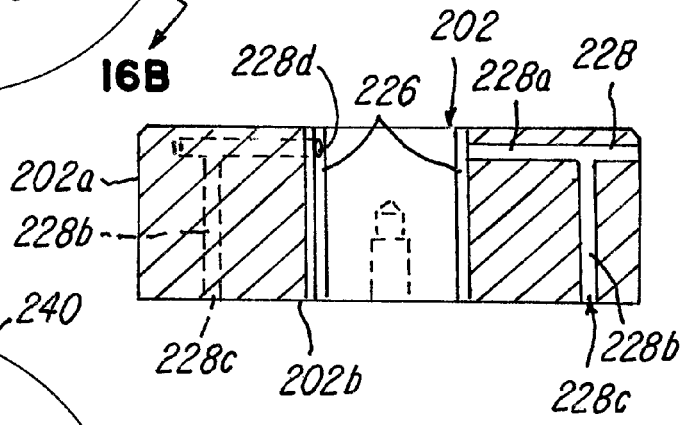

Referring now to FIGS. 14 and 16A-16B, the stationary journal bearing 202 will now be described. The stationary journal bearing 202 comprises an outer wall or surface of 202*a* and an inner wall or surface 202*b* that defines an area 224 (FIGS. 14 and 16A) for receiving the sleeve bearing 44' as shown. The stationary journal bearing 202 comprises a plurality of axial channels, grooves or passageways 226 as shown.

As illustrated in FIGS. 14 and 16B, notice that the bearing 202 further comprises a plurality of the internal passageways 228 comprising a radial passageway portion 228*a* and an axial passageway portion 228*b* as shown. The passageway 228 has an inlet 228*c* which is in fluid communication with the passageway 226 and an outlet 228*d* that is in fluid communication with the first stage area 26' as shown. The general radial passageway portion 228*a* which is in fluid communication with the axial passageway 228*b* and which cooperates to direct fluids from an area 230 (FIG. 12) to area 232 and into the first stage area 26' as illustrated in FIG. 12.

It should be understood that the axial aperture(s) 228*b* in bearing 202 are sized to meter the exact amount of fluid needed to cool the motor. The axial aperture(s) 228*b* in bearing 200 are sufficiently large to minimize the pressure drop of flow from outer wall 200*a* to surface 200*d*.

Similar to the operation of the embodiment described earlier relative to the FIGS. 1-11, this embodiment permits fluid to flow from the second stage area 28' along the flow path indicated by arrow A to the first stage area 26'. In this regard, fluid in the second stage area 28' enters the passageways 220 and moves through aperture 240 and past the rotor 36'. Note that a portion of the fluid circulates back through the area 223 which is caused by a suction or pumping action caused by the rotating impeller 66'.

Some of the fluid (in the lower part of FIG. 12) flows generally perpendicular to the axis of shaft 38' until it reaches the thrust bearing 204 and then moves into the area 222. The fluid flows past the rotor 36' and stator 34' and into the area 230. The fluid flows into the area 330 and ultimately back into the first stage area 26'. Note that a portion of the fluid circuits into passageway 228 as show and generally in a radial direction (as viewed in FIG. 12).

Advantageously, this embodiment provides the same advantages and benefits as the embodiment described earlier herein, but with the various bearings 200, 202, 204 and 206 being adapted or configured in the manner shown and described.

Figure 21:
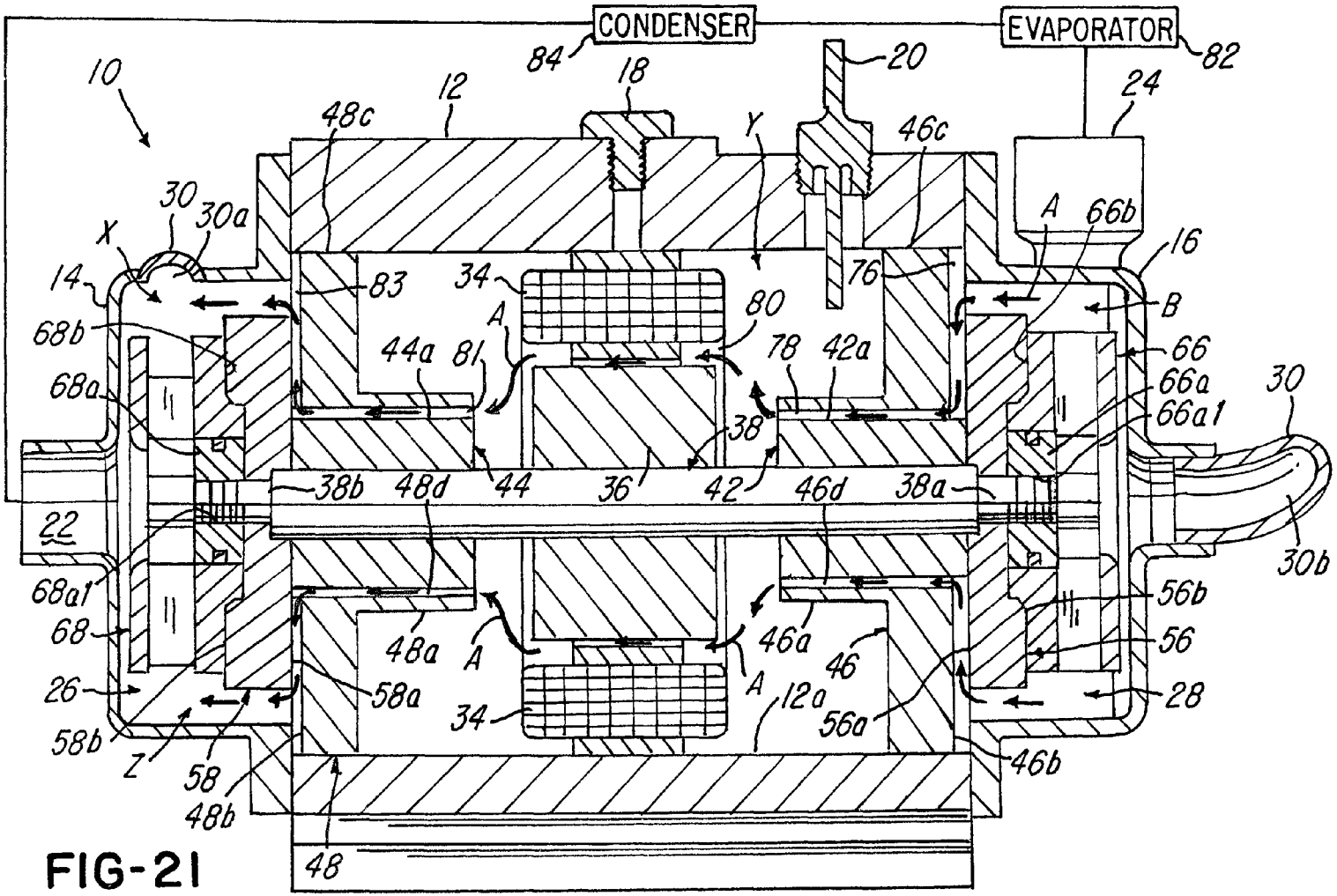
FIG. 21 is a sectional view of another embodiment.

It should be understood, that other variations of the embodiments shown in FIGS. 1-20 may also be used or the features of the various embodiments may be combined. The size of the various passageways, channels, apertures and conduits that are used will vary depending upon various factors, such as the cooling and lubricating requirements of the motor and the like. For example, the various thrust and sleeve bearings of the embodiments being described may be mixed or may be used in combination with some additional considerations and/or advantages that will now be described. Another important variation is that the sleeve bearings may not be necessary and may be omitted altogether. If the motor or shaft 38 speed was high enough, the motor shaft 38 surface can be the bearing surface. In other words, the higher the available bearing surface speed, the smaller the required sleeve bearing diameter. Also, the sleeve bearing may be provided combined with or integral with the stationary bearing. FIG. 21 illustrates an embodiment wherein the sleeve bearings are eliminated and the internal diameters of the mating stationary bearings have been reduced to 0.5 inches to match the outer diameter of the shaft. Thus, the sleeve bearings and stationary bearings may be provided in an integral, one-piece construction.

It should be understood that no separate liquid or lubricating oil is needed to lubricate the bearings in the embodiments described. As mentioned earlier, at least a portion of the fluid being pumped by the pump 10 is also the fluid that is serving as a working fluid or lubricating fluid. The fluid in this internal cycle is sub-cooled and flows internally from the second stage area 28' back to the first stage area 26' and removes heat generated by the motor in the pump 10 and also heat present at hydrodynamic bearings surfaces, which is generated by shearing the working fluid. By maintaining the fluid in a sub-cooled state in the manner described herein, the fluid is prevented from vaporizing. Again, the pressure differential between the first stage area 26' and the second stage area 28' provides the aforementioned flow from the second stage area 28' to the first stage area 26'. The geometry of the various passageways, such as passageways 90 and 208 and the associated reservoirs 94 and 210, respectively, facilitate establishing a supporting film of liquid for lubricating the areas between the bearing components. The film eliminates or reduces metal-to-metal contact between the rotating and stationary members during normal operation.

Figure 13:
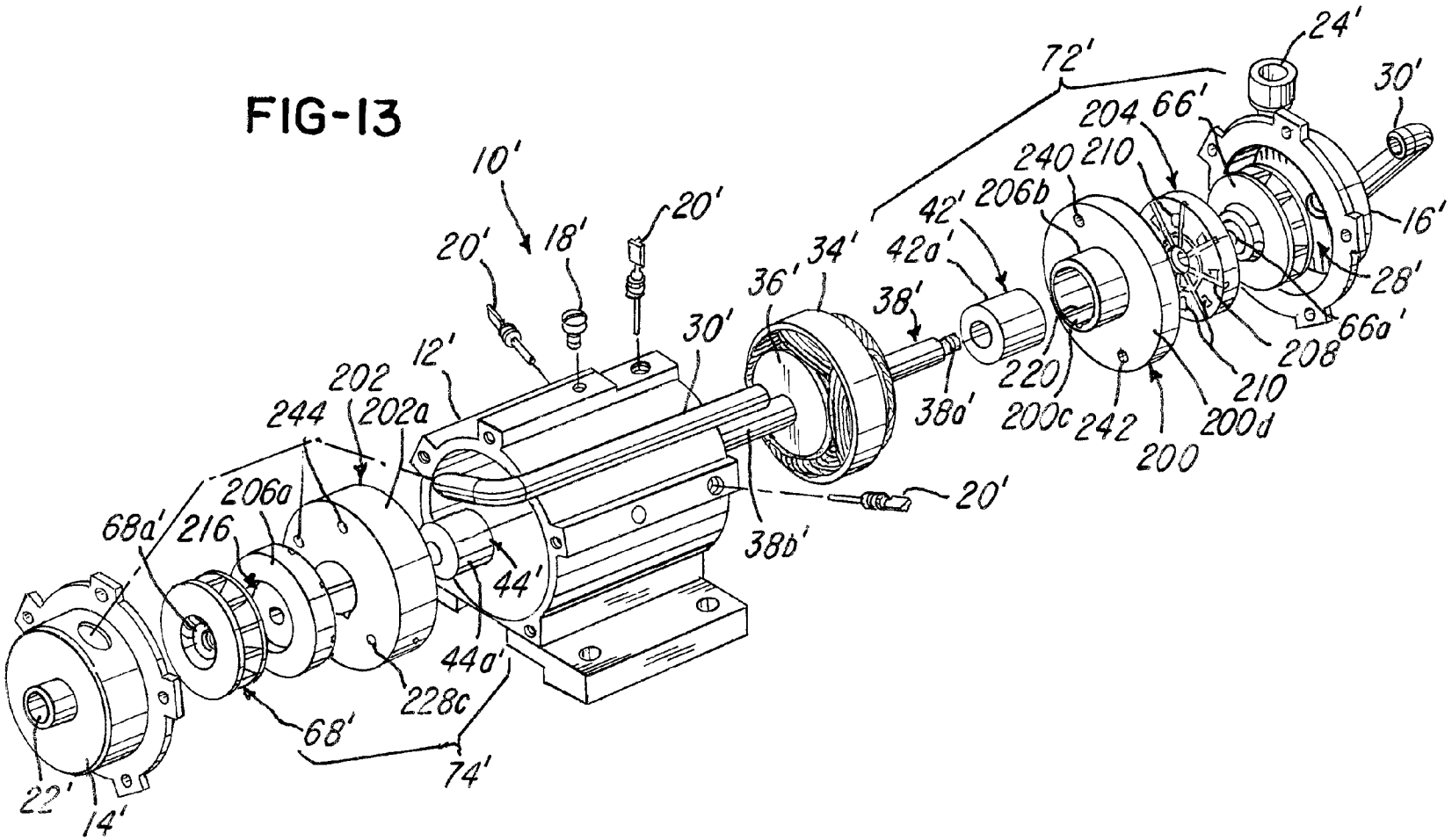
FIG. 13 is an exploded view of the pump shown in FIG. 12.

The thrust bearings 204 and 206 are separate components that mate with the impellers 66' and 68' in the manner described earlier herein. Alternatively, the impellers 66' and 68' may be provided with a rear face integrally formed with the passageways 208 and reservoirs 210 in order to thrust bearing function described herein. Alternatively, the components may be provided in a separate construction as illustrated in FIGS. 2 and 13. The journal bearings 46 and 48 illustrated in the embodiments in FIGS. 6A-6B and FIGS. 7A-7B may be used with the bearing 56 in FIGS. 8A-8B or used in combination with one of the bearings 202, 204 of the type shown in FIGS. 16A and 17A.

It should also be understood that the impellers 66 and 68 are substantially the same as in the embodiments described in FIGS. 1-20, but it should be understood that they do not have to be equal in size or thrust capability. Also, the various thrust bearings could have different thrust characteristics if desired. These features may facilitate reducing or eliminating any net axial thrust caused, for example, by the fluid flowing between the second stage area 28 and the first stage area 26.

It is believed that the pump 10 will possess a longer life compared to pumps that utilize bearings having metal-to-metal contact and that require separate lubrication.

Figure 17A:
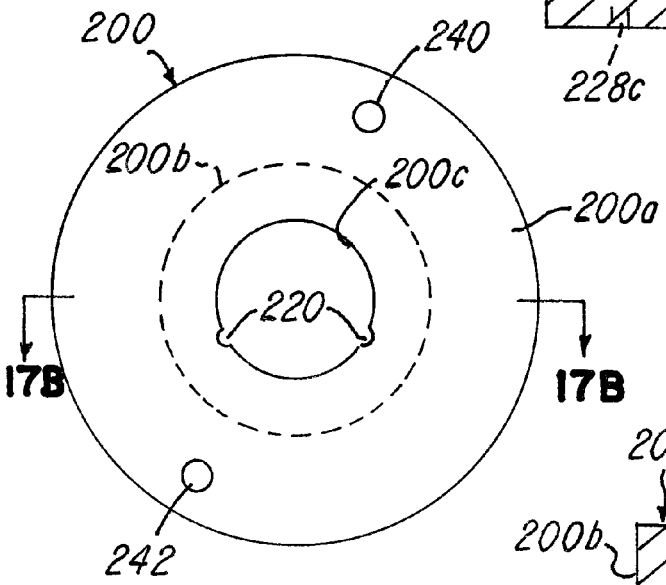
FIGS. 17A-17B are various views of another stationary bearing used in the pump of FIG. 12, with FIG. 17B being a sectional view taken along line 17B-17B in FIG. 17A.
Figure 17B:
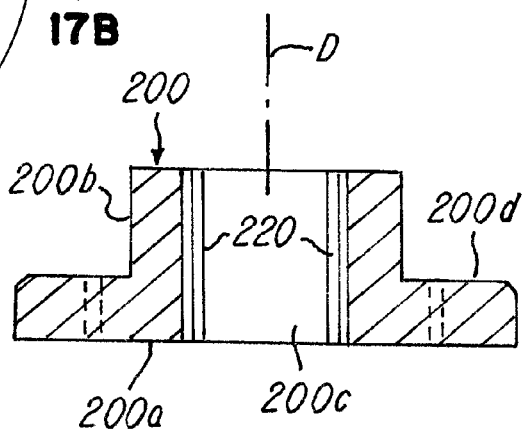

If it is desired to increase a flow between the second stage area 28 and the first stage area 26, a plurality of apertures of the same or various sizes, such as apertures 240 (FIG. 17A) and 242, may be provided in the journal bearing 200, as illustrated in FIG. 17B, to further facilitate the flow of fluid from the second stage area 28' and into the chamber Y. Likewise, the bearing 202 may also be provided with one or more passageways 244 (FIG. 16A) that permits fluid to flow directly through the bearing 202 and into the first stage area 26'. Note that the various passageways 202, 222, 208, 220, 226 and the like are adapted, configured and dimensioned in response to the flow rate desired, which may vary depending upon the cooling and lubricating requirements of the pump 10.

Advantageously, the embodiment illustrated in FIGS. 12-20 provide the same or similar advantages as the embodiment described earlier herein and provide hydrodynamic bearings for use in the pump 10 and means for lubricating those bearings and substantially simultaneously providing means for cooling a motor in the pump 10. The embodiment being described also permits sub-cooling of the fluid between the second stage area 28 and back to the first stage area 26 in the manner described and shown. This embodiment is different from the first embodiment in that the thrust bearings create centrifugal pumping action due to the fact that bearing geometry grooves are cut into these dynamic, rotating thrust bearings.

A seal-less, centrifugal hermetic pump comprises hydrodynamic bearings operating with liquid and no lubricating oil, wherein the liquid is a working fluid of the pump.

Advantageously, the axial and radial bearing surfaces feature pressure-generating geometry, establishing a supporting film of liquid. This film eliminates metal-to-metal contact between the rotating and stationary members during normal operation. The two pump impellers incorporate said pressure-generating geometry on their rear face, doubling as a thrust bearing. The two impeller diameters do not have to be equal, thus eliminating or reducing the net axial thrust. The pump, operating in a controlled environment will possess extreme long-life, resulting from negligible to zero metal-to-metal contact.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A multistage sealed direct drive pump for pumping a fluid, said pump comprising:

an electric motor having a motor shaft;

a plurality of impellers mounted on said motor shaft;

a housing enclosing said electric motor and said plurality of impellers;

a fluid path providing fluid communication from a first area associated with a first of said plurality of impellers to a second area associated with a second of said plurality of impellers, said second area being adapted to define a second stage of said multistage sealed direct drive pump; and at least one hydrodynamic bearing for supporting said motor shaft, wherein said at least one hydrodynamic bearing comprising at least one surface and a generally opposing surface, said at least one surface comprising at least one fluid conduit for permitting said fluid to flow from said second area to said first area to lubricate said at least one hydrodynamic bearing and said electric motor, thereby removing heat generated by said electric motor and lubricating said at least one hydrodynamic bearing, wherein said fluid is a liquid refrigerant;

said at least one fluid conduit extending across said at least one surface so that when said at least one fluid conduit receives said fluid, said fluid flows through said at least one fluid conduit and between said at least one surface and said generally opposing surface to lubricate said at least one hydrodynamic bearing when said at least one surface rotates relative to said generally opposing surface, and as fluid flows from said second area to said first area, said at least one hydrodynamic bearing being primarily supported with a force resulting from dynamic pressure of said fluid produced by rotation of said motor shaft.

2. The multistage sealed direct drive pump of claim 1 wherein said electric motor is immersed in said fluid, said pump further comprising a plurality of hydrodynamic bearings, each having at least one fluid conduit for permitting at least some of said fluid to cool said electric motor and to lubricate said plurality of hydrodynamic bearings.

3. The multistage sealed direct drive pump of claim 1 wherein said fluid is conveyed in the fluid path between said plurality of impellers by one or more channels within the housing, said at least one fluid conduit in said at least one hydrodynamic bearing being in fluid communication with said one or more channels.

4. The multistage sealed direct drive pump of claim 1 wherein said fluid is conveyed in the fluid path between said plurality of impellers by one or more channels external to the housing, said at least one fluid conduit in said at least one hydrodynamic bearing being in fluid communication with at least one fluid path interior to said pump.

5. The multistage sealed direct drive pump of claim 1 wherein said at least one hydrodynamic bearing comprises a sleeve portion and a generally planar portion that lies in a plane that is generally radial to an axis of said sleeve portion; said generally planar portion comprising a face having at least one groove extending across said face and said sleeve portion having a sleeve groove extending along said axis, said at least one groove and said sleeve groove being in fluid communication such that fluid may flow through said at least one hydrodynamic bearing.

6. The multistage sealed direct drive pump of claim 1 wherein said at least one hydrodynamic bearing comprises a sleeve portion and a generally planar portion that lies in a plane that is generally radial to an axis of said sleeve portion; said generally planar portion comprising a face having a plurality of face grooves extending across said face and said sleeve portion having a plurality of sleeve grooves extending along said axis, said plurality of face grooves being in fluid communication with said plurality of sleeve grooves, respectively, so that fluid may flow across said face and through said sleeve portion.

7. The multistage sealed direct drive pump of claim 6 wherein said face comprises a plurality of fluid collection areas in fluid communication with said plurality of face grooves, respectively.

8. A multistage pump for pumping a fluid, said multistage pump comprising:

a housing;

an electric motor mounted in said housing, said electric motor comprising a stator and a rotor mounted on a motor shaft and situated in operative relationship to said stator;

a first impeller associated with a first stage area for pressurizing said fluid to a first predetermined level;

a second impeller associated with a second stage area that is in fluid communication with said first stage area, said second impeller pressurizing fluid received from said first stage area to a second predetermined level; and a first hydrodynamic bearing assembly associated with said first impeller and a second hydrodynamic bearing assembly associated with said second impeller;

said first and second hydrodynamic bearing assemblies being adapted to permit said fluid to flow from said second stage area to said first stage area to lubricate at least one of said first and second hydrodynamic bearing assemblies and said electric motor and to lubricate each of said first and second hydrodynamic bearing assemblies, wherein said fluid is a liquid refrigerant;

said first and second hydrodynamic bearing assemblies each comprising a surface and a generally opposing surface, said at least one fluid conduit extending across said surface so that when said at least one fluid conduit receives said fluid, said fluid flows through said at least one fluid conduit and causes each of said first and second hydrodynamic bearing assemblies to be lubricated as fluid flows from said second stage area to said first stage area, each of said first and second hydrodynamic bearing assemblies being primarily supported with a force resulting from dynamic pressure of said fluid produced by rotation of said motor shaft and as said surface rotates relative to said generally opposing surface.

9. The multistage pump for pumping fluid as recited in claim 8 wherein each of said first and second hydrodynamic bearing assemblies comprises a stationary bearing having a face comprising a pressure-generating geometry for cooperating with a thrust bearing to facilitate providing a supporting film on said face.

10. The multistage pump for pumping fluid as recited in claim 8 wherein each of said first and second hydrodynamic bearing assemblies comprises a stationary bearing having a sleeve for receiving a sleeve journal bearing mounted on said motor shaft, said sleeve comprising a surface having a second pressure-generating geometry for facilitating providing a supporting film of fluid between said sleeve and said sleeve journal bearing.

11. The multistage pump for pumping fluid as recited in claim 9 wherein each of said first and second hydrodynamic bearing assemblies comprises said stationary bearing having a sleeve for receiving a sleeve journal bearing mounted on said motor shaft, said sleeve comprising a surface having a second pressure-generating geometry for facilitating providing a supporting film of fluid between said sleeve and said sleeve journal bearing.

12. The multistage pump for pumping fluid as recited in claim 8 wherein each of said first and second hydrodynamic bearing assemblies comprises a thrust bearing for facilitating rotation of said first and second impellers, respectively, and also a radial sleeve for providing a bearing for facilitating rotation of said motor shaft, each of said first and second hydrodynamic bearings having fluid passageways for delivering fluid to said thrust bearing and a sleeve.

13. The multistage pump of claim 8 wherein said fluid is conveyed in a fluid conduit from said first impeller to said second impeller, each of said first and second hydrodynamic bearing assemblies comprising at least one fluid conduit in fluid communication with one or more channels to permit fluid to flow from said second stage area to said first stage area, thereby lubricating said first and second hydrodynamic bearing assemblies and cooling said electric motor, where said fluid conduit permits flow from said first stage area to said second stage area.

14. The multistage pump of claim 8 wherein said first and second impellers comprise a different diameter to facilitate eliminating or reducing a net axial thrust associated with said motor shaft.

15. The multistage pump as recited in claim 8 wherein said first predetermined level is less than said second predetermined level.

16. The multistage pump as recited in claim 8 wherein each of said first and second hydrodynamic bearing assemblies comprises:

a bearing body comprising a sleeve portion and a generally planar portion extending generally radially from said bearing body;

a thrust bearing that cooperates with said generally planar portion;

a sleeve member for situating on said motor shaft;

at least one of said bearing body, said thrust bearing or said sleeve member comprising fluid conduits adapted to cause a hydrodynamic film for lubricating said first and second hydrodynamic bearing assemblies.

17. The multistage pump as recited in claim 16 wherein said at least one of said bearing body comprises a first end and a second end and further comprising a first plurality of channels, each of said first plurality of channels having a first channel area extending generally radially from a first edge associated with said first end and a second channel area extending generally axially to a second edge associated with said second end.

18. The multistage pump as recited in claim 17 wherein said first channel area defines an opening through said first edge associated with said first end and said second channel area defines an opening through said second edge associated with said second end to facilitate providing fluid communication between said first edge and said second edge, respectively.

19. The multistage pump as recited in claim 18 wherein said at least one of said bearing body further comprises a second plurality of channels, each of said second plurality of channels having a third channel area extending generally radially from said first edge associated with said first end and a fourth channel area extending generally axially to said second edge associated with said second end, at least one of said third channel area or said fourth channel area extending through said first edge or said second edge, respectively, while the other of said third channel area or said fourth channel area do not extend through said first edge or said second edge, respectively.

20. The multistage pump as recited in claim 16 wherein said bearing body comprises at least one channel adapted to provide fluid to said sleeve portion and said generally planar portion.

21. The multistage pump as recited in claim 16 wherein said bearing body comprises at least one channel adapted to provide fluid to said sleeve portion and said generally planar portion.

22. The multistage pump as recited in claim 16 wherein said fluid conduits are located in said thrust bearing.

23. The multistage pump as recited in claim 16 wherein said fluid conduits are located in both said thrust bearing and said bearing body.

24. The multistage pump as recited in claim 16 wherein said bearing body and said sleeve member are an integral, one-piece construction.

25. A hermetic pump for pumping a fluid;

a housing;

an electric motor situated in said housing, said electric motor comprising a motor shaft;

at least one impeller mounted on said motor shaft, said at least one impeller comprising a first impeller situated at a first stage area and a second impeller situated at a second stage area, said first and second stage areas being cooled by a fluid passageway through which fluid flows from said first stage area to said second stage area; and at least one hydrodynamic bearing assembly for rotatably supporting said motor shaft, said at least one hydrodynamic bearing assembly comprising a first bearing surface and a second bearing surface;

said at least one hydrodynamic bearing assembly being adapted to permit fluid being pumped to flow from said second impeller at said second stage area to said first impeller at said first stage area to cool said electric motor and substantially simultaneously to lubricate said at least one hydrodynamic bearing assembly while said fluid is pumped from said first stage area to said second stage area, wherein said fluid is a liquid refrigerant;

said at least one hydrodynamic bearing assembly comprising said at least one fluid conduit that extends across at least one of said first bearing surface or said second bearing surface so that when said at least one fluid conduit receives said fluid, said fluid flows through said at least one fluid conduit and causes said first or second bearing surfaces to be lubricated as fluid flows from said second stage area to said first stage area, said at least one hydrodynamic bearing assembly being primarily supported with a force resulting from dynamic pressure of said fluid produced by rotation of said motor shaft.

26. The hermetic pump as recited in claim 25 wherein said hermetic pump comprises:

a plurality of impellers mounted on said motor shaft; and a plurality of hydrodynamic bearing assemblies adapted to permit the fluid being pumped to cool said electric motor and substantially simultaneously to lubricate said at least one hydrodynamic bearing assembly.

27. The hermetic pump as recited in claim 26 wherein said housing comprises a first area and a second area and said plurality of impellers comprises a first impeller associated with a first area and a second impeller associated with a second area, respectively, said plurality of hydrodynamic bearing assemblies comprising a first bearing assembly for rotatably supporting said motor shaft and providing a first thrust bearing for said first impeller and a second bearing assembly for rotatably supporting said motor shaft and also for providing a second thrust bearing for said second impeller.

28. The hermetic pump as recited in claim 25 wherein said at least one hydrodynamic bearing assembly comprises a body comprising at least one channel for channeling fluid in order to lubricate said at least one hydrodynamic bearing assembly.

29. The hermetic pump as recited in claim 25 wherein said at least one hydrodynamic bearing assembly comprises a body comprising a plurality of grooves for channeling fluid in order to lubricate said at least one hydrodynamic bearing assembly.

30. The hermetic pump as recited in claim 25 wherein said at least one hydrodynamic bearing assembly comprises:

a first body member;

a first bearing member for situating between said first body member and said motor shaft;

a second bearing member for situating between said first body member and said at least one impeller; and at least one of said first body member, said first bearing member or said second bearing member comprising at least one conduit for permitting the fluid to lubricate interfaces between said first body member, said first bearing member and said second bearing member.

31. The hermetic pump as recited in claim 30 wherein said first body member comprises a first end and a second end and further comprising a first plurality of channels, each having a first channel area extending generally radially from a first edge associated with said first end and a second channel area extending generally axially to a second edge associated with said second end.

32. The hermetic pump as recited in claim 31 wherein said first channel area defines an opening through said first edge associated with said first end and said second channel area defines an opening through said second edge associated with said second end to facilitate providing fluid communication between said first edge and said second edge, respectively.

33. The hermetic pump as recited in claim 31 wherein said first body member further comprises a second plurality of channels, each of said second plurality of channels having a third channel area extending generally radially from said first edge associated with said first end and a fourth channel area extending generally axially to said second edge associated with said second end, at least one of said third channel area or said fourth channel area extending through said first edge or said second edge, respectively, while the other of said third channel area or said fourth channel area not extending through said first edge or said second edge, respectively.

34. The hermetic pump as recited in claim 30 wherein said first body member comprises at least one channel adapted to provide fluid to said first bearing member.

35. The hermetic pump as recited in claim 30 wherein said first body member comprises at least one channel adapted to provide fluid to said second bearing member.

36. A multistage pump for pumping a fluid comprising:

a housing;

an electric motor hermetically sealed within the housing, said electric motor comprising a motor shaft;

a first impeller mounted on said motor shaft and associated with a first area in said housing;

a second impeller mounted on said motor shaft and associated with a second area in said housing, said second area adapted to define a second stage and said first area adapted to define a first stage of said multistage pump;

at least one passageway for permitting fluid communication from said first area to said second area;

at least one bearing having at least one lubricating passageway, separate from said at least one passageway, adapted to permit fluid to flow from said second area to said first area such that when said fluid that is being pumped by said multistage pump said fluid lubricates said at least one bearing, where said fluid is a liquid refrigerant;

said at least one bearing comprising a bearing surface and an opposing bearing surface, said bearing surface having said at least one lubricating passageway across said bearing surface thereof so that when said at least one lubricating passageway receives said fluid, said fluid flows through said at least one lubricating passageway and lubricates said at least one bearing as fluid flows from said second area to said first area as said bearing surface or said opposed bearing surface is rotated, said at least one bearing being primarily supported with a force resulting from dynamic pressure of said fluid produced by rotation of said motor shaft.

37. The multistage pump as recited in claim 36 wherein said at least one bearing is a hydrodynamic bearing.

38. The multistage pump as recited in claim 36 wherein said at least one bearing comprises a first bearing assembly associated with said first impeller and a second bearing assembly associated with said second impeller.

39. The multistage pump as recited in claim 38 wherein said first and second bearing assemblies each comprise a thrust bearing member, a stationary member and a sleeve bearing member, at least one of said thrust bearing member, said stationary member and said sleeve bearing member comprises at least one lubricating passageway.

40. The multistage pump as recited in claim 38 wherein said first and second bearing assemblies each comprise a thrust bearing member, an intermediate member and a radial bearing member, a plurality of said thrust bearing member, said intermediate member and said radial bearing member comprises said at least one lubricating passageway.

41. The multistage pump as recited in claim 39 wherein said stationary member comprises at least one lubricating passageway.

42. The multistage pump as recited in claim 39 wherein said thrust bearing member comprises said at lest one lubricating passageway.

43. The multistage pump as recited in claim 40 wherein said at least one lubricating passageway comprises a radial portion that is in fluid connection with an axial portion.

44. A multistage pump comprising:

a housing comprising an electric motor having a motor shaft;

a first impeller associated with a first area inside said housing;

a second impeller associated with a second area inside said housing, said second area being adapted to define a second stage of said multistage pump;

a first bearing member mounted in said housing; and first rotating member situated between said first impeller and said first bearing member;

said first bearing member and said first rotating member being adapted to define a first hydrodynamic bearing that permits a fluid to flow from said second area to said first area, thereby lubricating said first hydrodynamic bearing, wherein said fluid is a liquid refrigerant;

said first bearing member comprising said at least one fluid conduit over a surface of said first bearing member so that when said at least one fluid conduit receives said fluid, said first bearing member becomes lubricated as fluid flows from said second area to said first area and said first bearing member rotates, said first bearing member being primarily supported with a force resulting from dynamic pressure of said fluid produced by rotation of said motor shaft.

45. The multistage pump as recited in claim 44 wherein said multistage pump further comprises a second bearing member associated with said second impeller; and a second rotating member situated between said second impeller and said second bearing member, said second rotating member being situated between said second impeller and said second bearing member;

said second bearing member and said second rotating member being adapted to define a second hydrodynamic bearing.

46. The multistage pump as recited in claim 45 wherein said multistage pump further comprises a third bearing member mounted on said motor shaft; said first bearing member comprising a sleeve portion defining a sleeve area for rotatably receiving said third bearing member, said first bearing member comprising at least one fluid conduit for lubricating an interface between said first bearing member and each of said first rotating member and said third bearing member.

47. The multistage pump as recited in claim 46 wherein multistage pump further comprises a fourth bearing member mounted on said motor shaft; said second bearing member comprising a second sleeve portion defining a second sleeve area for rotatably receiving said fourth bearing member, said second bearing member comprising at least one fluid conduit for lubricating an interface between said second bearing member and each of said second rotating member and said fourth bearing member.

48. The multistage pump as recited in claim 46 wherein said multistage pump further comprises a fourth bearing member mounted on said motor shaft; said second bearing member comprising a second sleeve portion defining a second sleeve area for rotatably receiving said fourth bearing member, said second bearing member comprising at least one fluid conduit for lubricating an interface between said second bearing member and each of a second rotating member and said fourth bearing member.

49. A method for removing heat in a pump having a first stage area and a second stage area that is downstream of said first stage area;

creating a pressure differential between said first stage area and said second stage area, with said second stage area being at a higher pressure than said first stage area;

providing an internal flow path from said second stage area to said first stage area such that at least a portion of a fluid which flows from said first stage area to said second stage area and is coupled to flow back from said second stage area to said first stage area and as said fluid is being pumped by the pump so that said fluid that flows back from said second stage area to said first stage area lubricates at least one bearing and an electric motor in the pump and to remove heat generated by said electric motor thereby cooling the pump, wherein said fluid is a liquid refrigerant;

said at least one bearing comprising said at least one fluid conduit over a surface of said at least one bearing so that when said at least one fluid conduit receives said fluid, said at least one bearing becomes lubricated as fluid flows from said second stage area to said first stage area and by rotation of said at least a portion of said at least one bearing, said at least one bearing being primarily supported with a force resulting from dynamic pressure of said fluid produced by rotation of a motor shaft.

50. The method as recited in claim 49 wherein the method further comprises the step of:

causing fluid flowing along said internal flow path to be sub-cooled between said first and said second stage areas.

51. The method as recited in claim 49 wherein the method further comprises the step of:

providing a plurality of hydrodynamic bearings adapted to define at least a portion of said internal flow path.

52. The method as recited in claim 51 wherein said at least one of said plurality of hydrodynamic bearings is a stationary bearing having at least one passageway for directing said fluid along said internal flow path.

53. The method as recited in claim 51 wherein said at least one of said plurality of hydrodynamic bearings is a thrust bearing having at least one passageway for directing said fluid along said internal flow path.

54. A fluid pump having an inlet an outlet comprising:

a housing having an electric motor having a motor shaft;

a first impeller mounted on said shaft associated with a first stage area;

a second impeller mounted on said shaft associated with a second stage area, said second stage area being at a higher pressure than said first stage area;

a passageway for permitting a fluid to be pumped from said first stage area to said second stage area;

a first bearing assembly for rotatably supporting said first impeller;

a second bearing assembly for rotatably supporting said second impeller;

at least one flow path for permitting a fluid being pumped by said fluid pump to flow in said housing from said second stage area to said first stage area such that it provides lubrication for said first and second bearing assemblies substantially simultaneously as said fluid is pumped from said first stage area to said second stage area; wherein said fluid is a liquid refrigerant;

said first and second bearing assemblies each comprising a first bearing surface and a second bearing surface generally opposed to said first bearing surface, said at least one fluid conduit traversing at least one of said first bearing surface or said second bearing surface so that when said at least one fluid conduit receives said fluid, said first and second bearing assemblies become lubricated as fluid flows from said second stage area to said first stage area and at least one of said first bearing surface or said second bearing surface is rotated, said first and second bearing assemblies being primarily supported with a force resulting from dynamic pressure of said fluid produced by rotation of said motor shaft.

55. The fluid pump as recited in claim 54 wherein at least one flow path comprises a first flow path that permits fluid to flow from said first stage area to said second stage area and out said outlet and a second flow path for permitting at least a portion of said fluid to flow from said second stage area to said first stage area, wherein said second flow path is adapted or arranged to flow across said electric motor to cool said electric motor.

56. The fluid pump as recited in claim 55 wherein said second flow path is adapted or arranged to also provide cooling for said electric motor.

57. The fluid pump as recited in claim 55 wherein each of said first bearing assembly and said second bearing assembly comprises a plurality of hydrodynamic bearings, at least one of said plurality of hydrodynamic bearings comprising at least one passageway for defining at least a portion of said second flow path.

58. The fluid pump as recited in claim 55 wherein fluid flowing along said second flow path remains sub-cooled the entire time it flows along said second flow path.

* * * * *

UNITED STATES PATENT AND TRADEMARK OFFICE

CERTIFICATE OF CORRECTION

PATENT NO. : 7,758,320 B2
APPLICATION NO. : 11/743794
DATED : July 20, 2010
INVENTOR(S) : Hoa Dao Pham et al.

It is certified that error appears in the above-identified patent and that said Letters Patent is hereby corrected as shown below:

On the Title Page in (73) please delete "Tank, Inc." and insert --Tark, Inc.-- therefor.

In Column 2, Line 50, after inlet, please insert --and--.

In Column 3, Line 41, please delete the second "are various views".

In Column 12, Line 64, please delete "show" and insert --shown-- therefor.

In Column 20, Line 27, please delete "lest" and insert --least-- therefor.

In Column 22, Line 9, after inlet, please insert --and--.

Signed and Sealed this

Twenty-eighth Day of September, 2010

David J. Kappos

David J. Kappos
*Director of the United States Patent and Trademark Office*